US008565637B2

(12) United States Patent
Itabashi et al.

(10) Patent No.: US 8,565,637 B2
(45) Date of Patent: Oct. 22, 2013

(54) IMAGE FORMING DEVICE HAVING RETAINING MEMBER RETAINING TONER CARTRIDGES

(75) Inventors: Nao Itabashi, Nagoya (JP); Ryuya Yamazaki, Nagoya (JP); Naoya Kamimura, Ichinomiya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 144 days.

(21) Appl. No.: 13/086,631

(22) Filed: Apr. 14, 2011

(65) Prior Publication Data

US 2012/0027454 A1 Feb. 2, 2012

(30) Foreign Application Priority Data

Aug. 2, 2010 (JP) ..... 2010-173515

(51) Int. Cl.
*G03G 15/00* (2006.01)
*G03G 15/08* (2006.01)

(52) U.S. Cl.
USPC ..... 399/110; 399/258; 399/260

(58) Field of Classification Search
USPC ..... 399/110, 111, 114, 119, 411
See application file for complete search history.

(56) References Cited

U.S. PATENT DOCUMENTS

| | | | | |
|---|---|---|---|---|
| 6,115,571 | A | 9/2000 | Kobayashi | |
| 6,185,401 | B1 * | 2/2001 | Kanamori et al. | 399/262 |
| 6,944,415 | B2 * | 9/2005 | Nomura | 399/111 |
| 7,711,311 | B2 | 5/2010 | Watanabe et al. | |
| 7,751,729 | B2 | 7/2010 | Watanabe et al. | |
| 7,778,567 | B2 | 8/2010 | Igarashi et al. | |
| 7,869,720 | B2 | 1/2011 | Watanabe et al. | |
| 8,078,085 | B2 | 12/2011 | Okabe | |
| 8,107,829 | B2 | 1/2012 | Sato et al. | |
| 2006/0067734 | A1 | 3/2006 | Igarashi et al. | |
| 2008/0025758 | A1 | 1/2008 | Sato | |

(Continued)

FOREIGN PATENT DOCUMENTS

| | | |
|---|---|---|
| CN | 1167279 A | 12/1997 |
| CN | 1550928 A | 12/2004 |

(Continued)

OTHER PUBLICATIONS

CN First Office Action dtd Oct. 16, 2012, CN Appln. 201110146723.9, English translation.

(Continued)

*Primary Examiner* — Clayton E Laballe
*Assistant Examiner* — Jas Sanghera
(74) *Attorney, Agent, or Firm* — Banner & Witcoff, Ltd.

(57) ABSTRACT

An image-forming device includes: a main casing; a retaining member; developing units retained by the retaining member; toner cartridges; and an operating member provided at the retaining member. The retaining member is movably disposed between a position inside an accommodation space in the main casing, and a pull-out position. The toner cartridges are detachably attachable to the retaining member, when the retaining member is at the pull-out position. Each toner cartridge includes: a casing in which a through-hole is formed for supplying toner to a corresponding developing unit; and a shutter that moves between open and closed positions exposing and closing the through-hole, respectively. The operating member moves the shutter between the open and closed positions by shifting between first and second positions in which the operating member extends above the retaining member, and in which the operating member has a lower profile than in the first position, respectively.

19 Claims, 17 Drawing Sheets

(56) References Cited

U.S. PATENT DOCUMENTS

| | | | | |
|---|---|---|---|---|
| 2008/0166139 | A1 | 7/2008 | Watanabe et al. | |
| 2008/0166141 | A1 | 7/2008 | Watanabe et al. | |
| 2008/0166145 | A1 | 7/2008 | Watanabe et al. | |
| 2008/0226341 | A1* | 9/2008 | Mase et al. | 399/119 |
| 2008/0260422 | A1* | 10/2008 | Sasae et al. | 399/119 |
| 2009/0142079 | A1 | 6/2009 | Sato et al. | |
| 2009/0190953 | A1 | 7/2009 | Okabe | |
| 2010/0074646 | A1 | 3/2010 | Miyahara et al. | |
| 2010/0111562 | A1 | 5/2010 | Okabe et al. | |
| 2011/0280630 | A1 | 11/2011 | Itabashi | |

FOREIGN PATENT DOCUMENTS

| | | | |
|---|---|---|---|
| CN | 1755555 | A | 4/2006 |
| JP | H03-077941 | U | 8/1991 |
| JP | H04-296885 | A | 10/1992 |
| JP | H05-043389 | U | 6/1993 |
| JP | H06-130867 | A | 5/1994 |
| JP | H07-271250 | A | 10/1995 |
| JP | H08-054817 | A | 2/1996 |
| JP | 2003-107892 | A | 4/2003 |
| JP | 2004-258230 | A | 9/2004 |
| JP | 2005-326869 | A | 11/2005 |
| JP | 2006-098772 | | 4/2006 |
| JP | 2006-098776 | A | 4/2006 |
| JP | 2008-026830 | | 2/2008 |
| JP | 2008-170622 | A | 7/2008 |
| JP | 2009-139489 | A | 6/2009 |
| JP | 2009-175416 | A | 8/2009 |
| JP | 2010-078848 | A | 4/2010 |
| JP | 2010-107890 | A | 5/2010 |
| JP | 2011-242553 | A | 12/2011 |

OTHER PUBLICATIONS

Co-related U.S. Appl. No. 13/074,408, filed Mar. 29, 2011.
JP Office Action mailed Jul. 3, 2012, JP Appln. 2010-173514.
Non-final Office Action received in U.S. Appl. No. 13/074,408 mailed Mar. 5, 2013.

* cited by examiner

IMAGE FORMING DEVICE HAVING RETAINING MEMBER RETAINING TONER CARTRIDGES

CROSS REFERENCE TO RELATED APPLICATION

This application claims priority from Japanese Patent Application No. 2010-173515 filed Aug. 2, 2010. The entire content of this priority application is incorporated herein by reference.

TECHNICAL FIELD

The present invention relates to an image forming device, such as a laser printer, and a tandem type process unit.

BACKGROUND

There has been provided a tandem type color printer having four photosensitive drums integrally detachable from a main casing and corresponding to each of four colors yellow, magenta, cyan, and black.

In this type of color printer, a frame is provided in the main casing such that the frame can be pulled out from the main casing in a horizontal direction, for example. The four photosensitive drums are supported on the frame and juxtaposed with one another in a pull-out direction of the frame. Developing cartridges corresponding to the photosensitive drums are detachably mounted onto the frame from above. Each developing cartridge has a developing roller and accommodates toner therein. When any of the developing cartridges runs out of toner, then the frame is pulled outwardly from the main casing, and the developing cartridge is detached from the frame, and a new developing cartridge is mounted onto the frame.

SUMMARY

There has recently been demand for cost reductions and environmental concerns toward the printer manufactures and the like. In terms of cost reductions and environmental concerns, it is desirable to employ a toner cartridge replacing system, in which only a toner cartridge for accommodating toner is replaced without replacing the developing roller, rather than to replace the entire developing cartridge, when toner runs out.

It is an object of the invention to provide an improved image-forming device, in which a retaining member retaining a plurality of developing units is movably provided and toner cartridges are detachably mounted in the retaining member, and a tandem-type process unit having a retaining member that retains a plurality of image bearing members and that is detachably mounted with toner cartridges.

In order to attain the above and other objects, the invention provides an image-forming device including: a main casing; a retaining member; a plurality of developing units; a plurality of toner cartridges; and an operating member. The main casing defines an accommodation space. The retaining member is movably disposed between an accommodated position, in which the retaining member is accommodated inside the accommodation space, and a pull-out position. The plurality of developing units are retained by the retaining member. The plurality of toner cartridges are detachably attachable to the retaining member, one for each of the developing units, when the retaining member is at the pull-out position. Each of the toner cartridges includes: a casing in which a through-hole is formed for supplying toner accommodated inside the casing to the corresponding developing unit; and a shutter that is configured so as to be capable of moving between an open position exposing the through-hole and a closed position closing the through-hole. The operating member is provided at the retaining member. The operating member is configured to be operated to move the shutter between the open position and the closed position by shifting between a first position corresponding to the closed position of the shutter in which the operating member extends above the retaining member, and a second position corresponding to the open position of the shutter in which the operating member has a lower profile than in the first position.

According to another aspect, the present invention provides a tandem-type process unit including: a retaining member; a plurality of image bearing members; a plurality of developing units; a plurality of toner cartridges; and an operating member. The plurality of image bearing members are retained by the retaining member so as to be juxtaposedly arrayed with intervals between neighboring image bearing members. The plurality of developing units are retained by the retaining member, one for each of the image-bearing members. The plurality of toner cartridges are detachably attachable to the retaining member, one for each of the developing units. Each of the toner cartridges includes: a casing in which a through-hole is formed for supplying toner accommodated inside the casing to the corresponding developing unit; and a shutter that is configured so as to be capable of moving between an open position exposing the through-hole and a closed position closing the through-hole. The operating member is provided at the retaining member. The operating member is configured to be operated to move the shutter between the open position and the closed position by shifting between a first position corresponding to the closed position of the shutter in which the operating member extends above the retaining member, and a second position corresponding to the open position of the shutter in which the operating member has a lower profile than in the first position.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
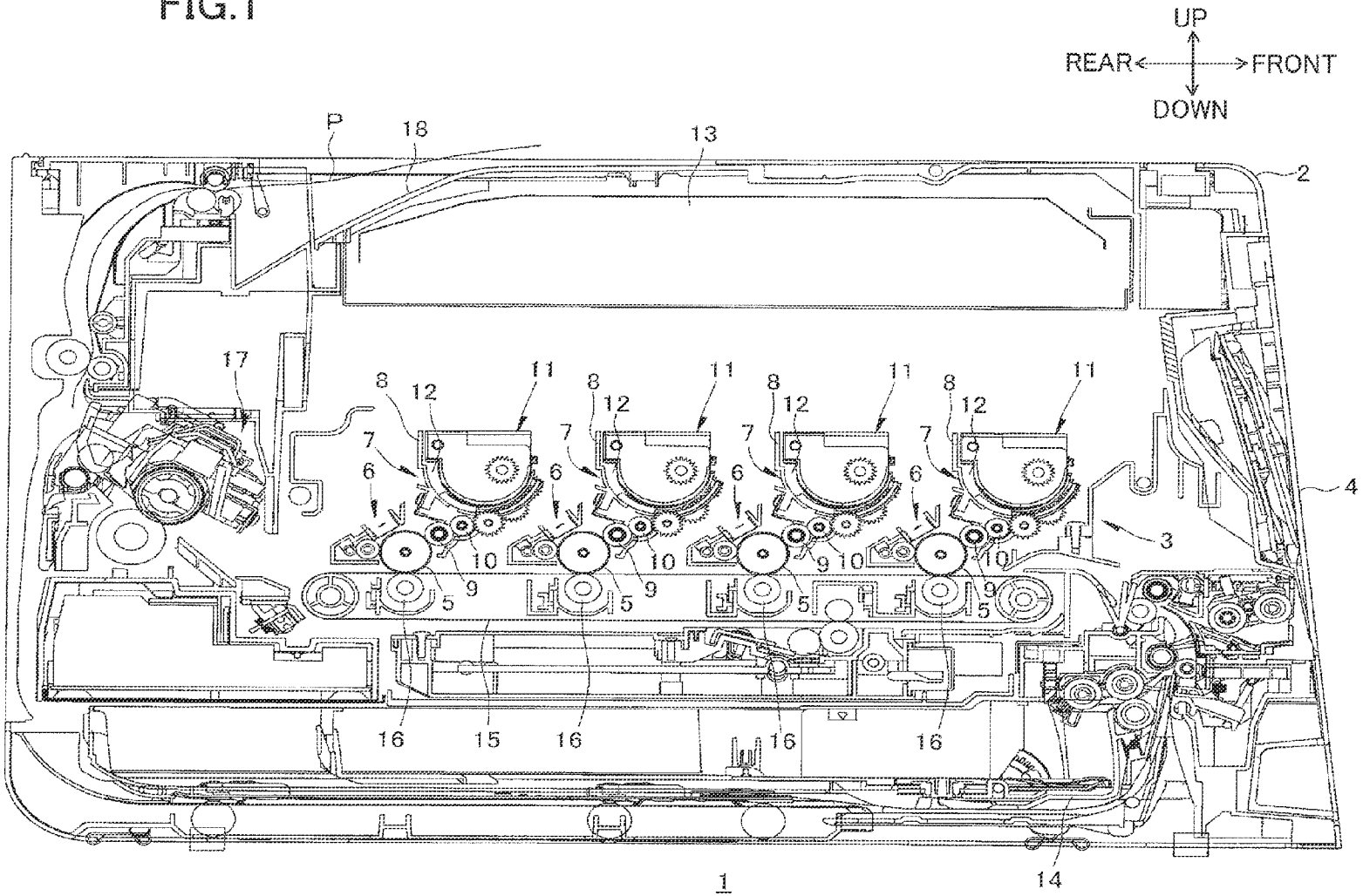
FIG. 1 is a cross-sectional left side view of a color printer according to a first embodiment of the invention.

An image forming device according to an embodiment of the invention will be described while referring to the accompanying drawings wherein like parts and components are designated by the same reference numerals to avoid duplicating description.

First, a color printer 1 as an image forming device according to an embodiment of the invention will be described while referring to FIGS. 1 to FIG. 7E.

As shown in FIG. 1, the color printer 1 is a tandem type color printer. As shown in FIGS. 1 to 4C, the color printer 1 includes a main casing 2 that accommodates a drawer unit (tandem type process unit) 3. The main casing 2 is provided with a front cover 4 that can be selectively opened and closed. The drawer unit 3 can move in a front-rear direction (horizontal direction) relative to the main casing 2 between an accommodated position within the main casing 2 (FIG. 2) and a pull-out position outside the main casing 2 (FIG. 3), when the front cover 4 is open.

Note that the terms "upward," "downward," "upper," "lower," "above," "below," "right," "left," "front," "rear," and the like will be used throughout the description assuming that the color printer 1 is disposed in an orientation in which it is intended to be used and that the drawer unit 3 and toner cartridges 11 (described later) mounted thereon are accommodated in the main casing 2, unless defined otherwise. In use, the color printer 1 is disposed as shown in FIG. 1. The left and right sides of the main casing 2 will be based on the perspective of a user looking at the color printer 1 from the front side. The front cover 4 is omitted in FIGS. 2 and 3.

The drawer unit 3 includes a drawer frame 31, four photosensitive drums (image bearing members) 5, four chargers 6 corresponding to the photosensitive drums 5, and four developing units 7 corresponding to the photosensitive drums 5.

As shown in FIG. 1, the drawer unit 3 (the drawer frame 31) supports the four photosensitive drums 5 such that the photosensitive drums 5 can rotate about respective rotary shafts extending along a right-left direction. The four photosensitive drums 5 are provided for respective colors black (K), yellow (Y), magenta (M), and cyan (C), and are aligned at fixed intervals in the front-rear direction. The order of the photosensitive drums 5 arranged from front to rear in this embodiment are those for colors black, yellow, magenta, and cyan.

The drawer unit 3 (the drawer frame 31) also supports the four chargers 6 and the four developing units 7. The chargers 6 are disposed diagonally rearward and upward of the respective photosensitive drums 5. Each charger 6 is a Scorotron charger including a wire and a grid. The developing units 7 are disposed diagonally frontward and upward of the respective photosensitive drums 5.

Each developing unit 7 includes a developing frame 8 that supports both a developing roller 9 and a supply roller 10.

The developing roller 9 is rotatable about a rotary shaft extending in the right-left direction and is disposed to contact the corresponding photosensitive drum 5.

The supply roller 10 is rotatable about a rotary shaft extending in the right-left direction and is disposed to contact an upper front section of the developing roller 9.

Four spaces 12 for accommodating the respective toner cartridges 11 are defined within the drawer unit 3 at positions above the developing units 7. The toner cartridges 11 are accommodated into the corresponding spaces 12 from above when the drawer unit 3 is at the pull-out position. The toner cartridge 11 accommodates toner therein and supplies the toner to the corresponding developing unit 7.

The color printer 1 also includes an exposing unit 13 accommodated in the main casing 2 at a position above the drawer unit 3. The exposing unit 13 irradiates four laser beams corresponding to each color.

A surface of each photosensitive drum 5 is uniformly charged by a discharge from the corresponding charger 6 as the photosensitive drum 5 rotates, and is then selectively exposed to the laser beam from the exposing unit 13. As a result, charges on the surface of the photosensitive drum 5 are selectively removed, thereby forming an electrostatic latent image on the surface of the photosensitive drum 5. When the electrostatic latent image is brought into confrontation with the corresponding developing roller 9, toner is selectively supplied onto the electrostatic latent image. As a result, a toner image is formed on the surface of the photosensitive drum 5.

Note that the color printer 1 may include four LED arrays, instead of the exposing unit 13.

The color printer 1 further includes a sheet supply cassette 14, a convey belt 15, four transfer rollers 16, and a fixing unit 17. The sheet supply cassette 14 is for accommodating paper sheets P and disposed in the bottom of the main casing 2. The paper sheets P accommodated in the sheet supply cassette 14 are conveyed one at a time onto the convey belt 15 by various rollers. The convey belt 15 is disposed below and opposite to the four photosensitive drums 5. The transfer rollers 16 are disposed in confrontation with the respective photosensitive drums 5 with an upper section of the convey belt 15 interposed therebetween. The paper sheet P conveyed onto the convey belt 15 is conveyed rearward by rotation of the convey belt 15 to pass through positions between the convey belt 15 and each photosensitive drum 5 in sequence. The toner image formed on the surface of each photosensitive drum 5 is transferred onto the paper sheet P when brought into confrontation therewith.

The fixing unit 17 is disposed on a downstream side of the convey belt 15 with respect to a sheet convey direction in which the paper sheet P is conveyed. The paper sheet P with toner images transferred thereon is conveyed to the fixing unit 17. The fixing unit 17 fixes the toner images onto the paper sheet P by heat and pressure. The paper sheet P with the toner images fixed thereon is discharged by various rollers onto a discharge tray 18 formed on an upper surface of the main casing 2.

Figure 2:
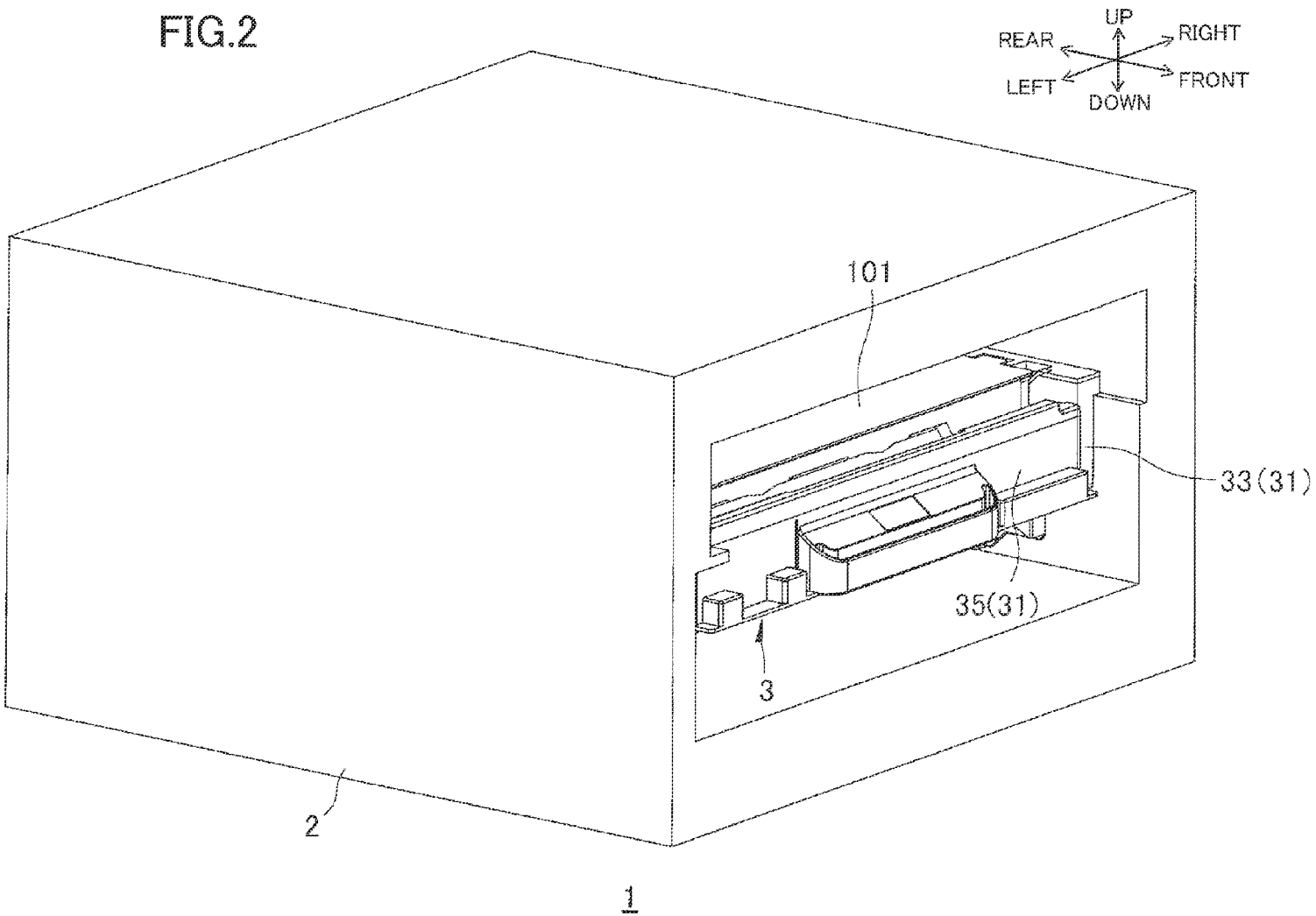
FIG. 2 is a perspective view of the color printer of FIG. 1, with a drawer unit at an accommodated position.
Figure 3:
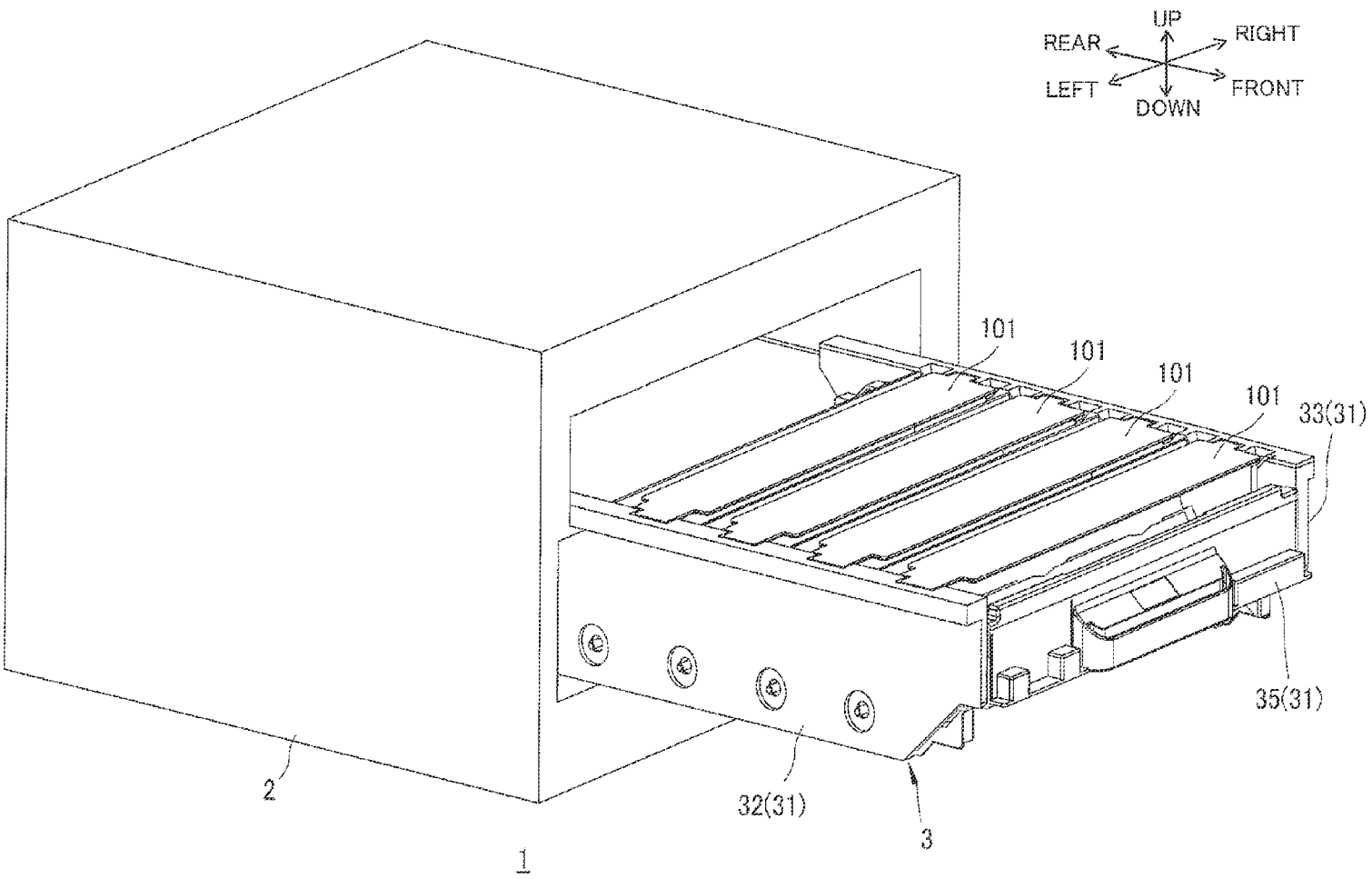
FIG. 3 is a perspective view of the color printer of FIG. 1, with the drawer unit at a pull-out position.

Note that the discharge tray 18 is omitted in FIGS. 2 and 3.

Figure 4A:
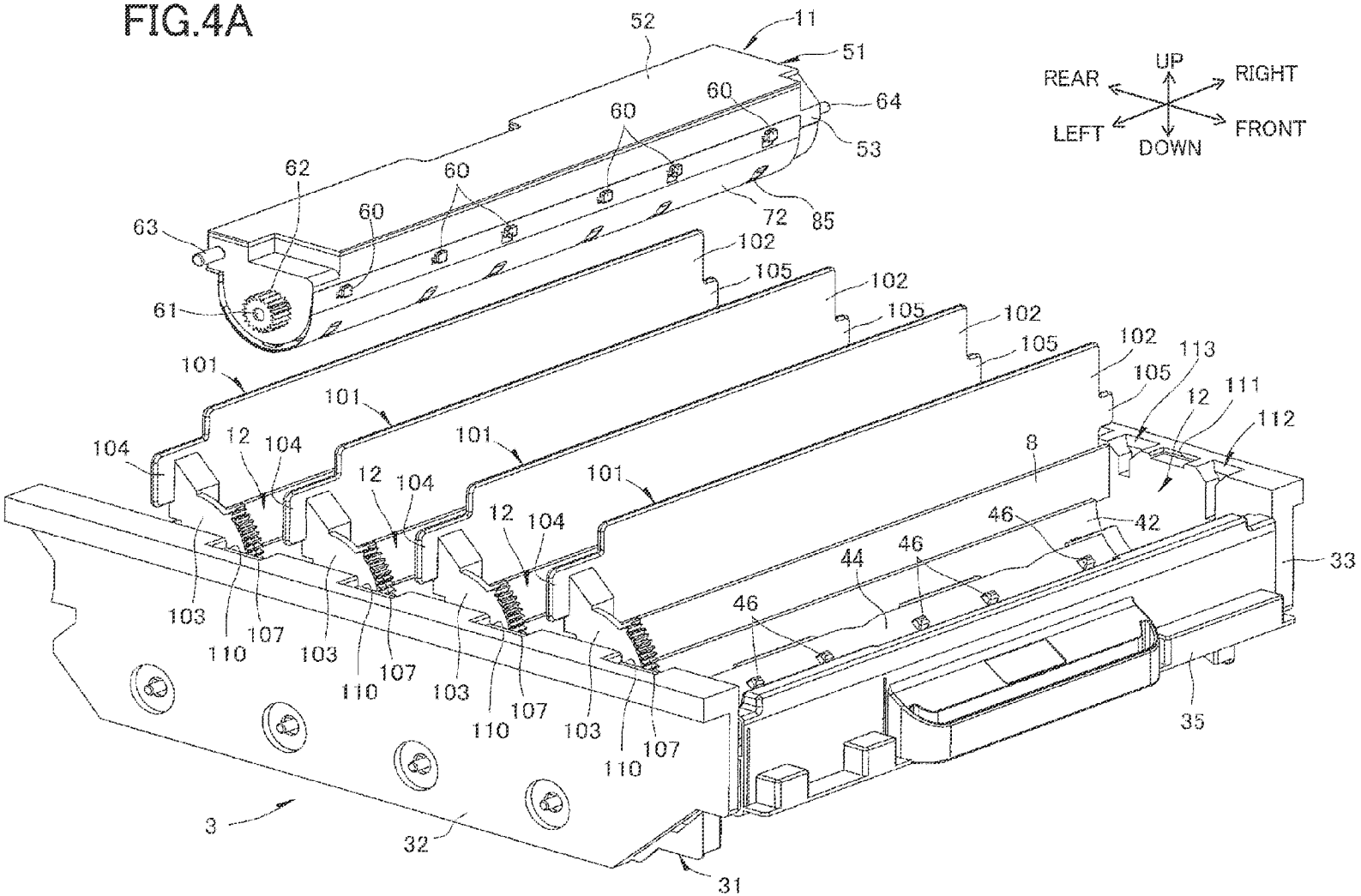
FIG. 4A is a perspective view of the drawer unit and a toner cartridge detached from the drawer unit.

As shown in FIG. 4A, the drawer frame (support member) 31 includes a pair of left and right side plates 32 and 33 disposed in confrontation with each other with a gap defined therebetween in the right-left direction, a front beam 35 spanning between front ends of the side plates 32 and 33, and a rear beam (not shown) spanning between rear ends of the side plates 32 and 33, and is formed in a rectangular frame shape on the whole in a plan view.

The four photosensitive drums 5, the four chargers 6, and the four developing units 7 (FIG. 1) are all supported by and sandwiched between the side plates 32 and 33 on the left and right sides. The spaces 12 are defined between the side plates 32 and 33 at positions above the developing units 7. In other words, the side plates 32 and 33 support the four photosensitive drums 5, the four chargers 6, and the four developing units 7, and are disposed opposite to each other in the right-left direction while defining a gap therebetween in the right-left direction for the spaces 12.

Figure 4B:
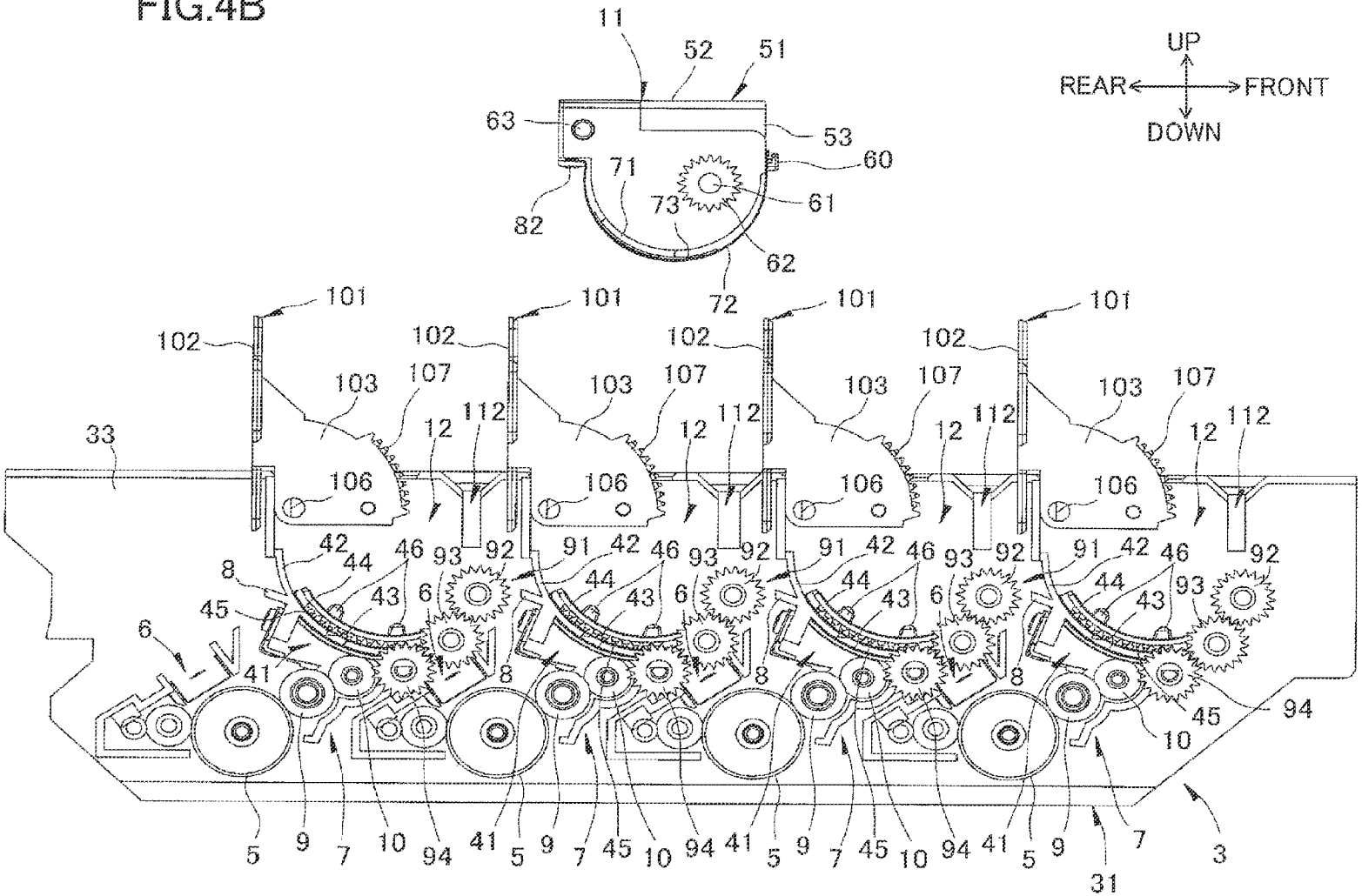
FIG. 4B is a cross-sectional left side view of the drawer unit and the toner cartridge detached from the drawer unit.

As shown in FIGS. 4A and 4B, the four developing frames 8 are juxtaposed with one another at regular intervals in the front-rear direction and spanning between the side plates 32 and 33. The spaces 12 are partitioned by the developing frames 8.

As shown in FIG. 4B, each developing frame 8 is formed with a developing chamber 41 for accommodating the developing roller 9. The developing chamber 41 is open on a photosensitive drum 5 side, and the developing roller 9 is disposed at this open end of the developing chamber 41.

Each developing frame 8 is provided with a plate-shaped partitioning wall 42 located between the developing chamber 41 and the space 12. The partitioning wall 42 protrudes in an arc shape toward the developing chamber 41, and partitions the interior of the developing frame 8 into the developing chamber 41 and the space 12 located above the developing chamber 41. The partitioning wall 42 is formed with three rectangular openings 43 (only one of which is shown) at a circumferential center thereof, at positions that oppose respective three communication ports 58 (FIG. 5) formed in the toner cartridge 11 when the toner cartridge 11 is accommodated in the space 12. The three rectangular openings 43 are formed in the partitioning wall 42 as being arranged at intervals in the right-to-left direction.

Figure 4C:
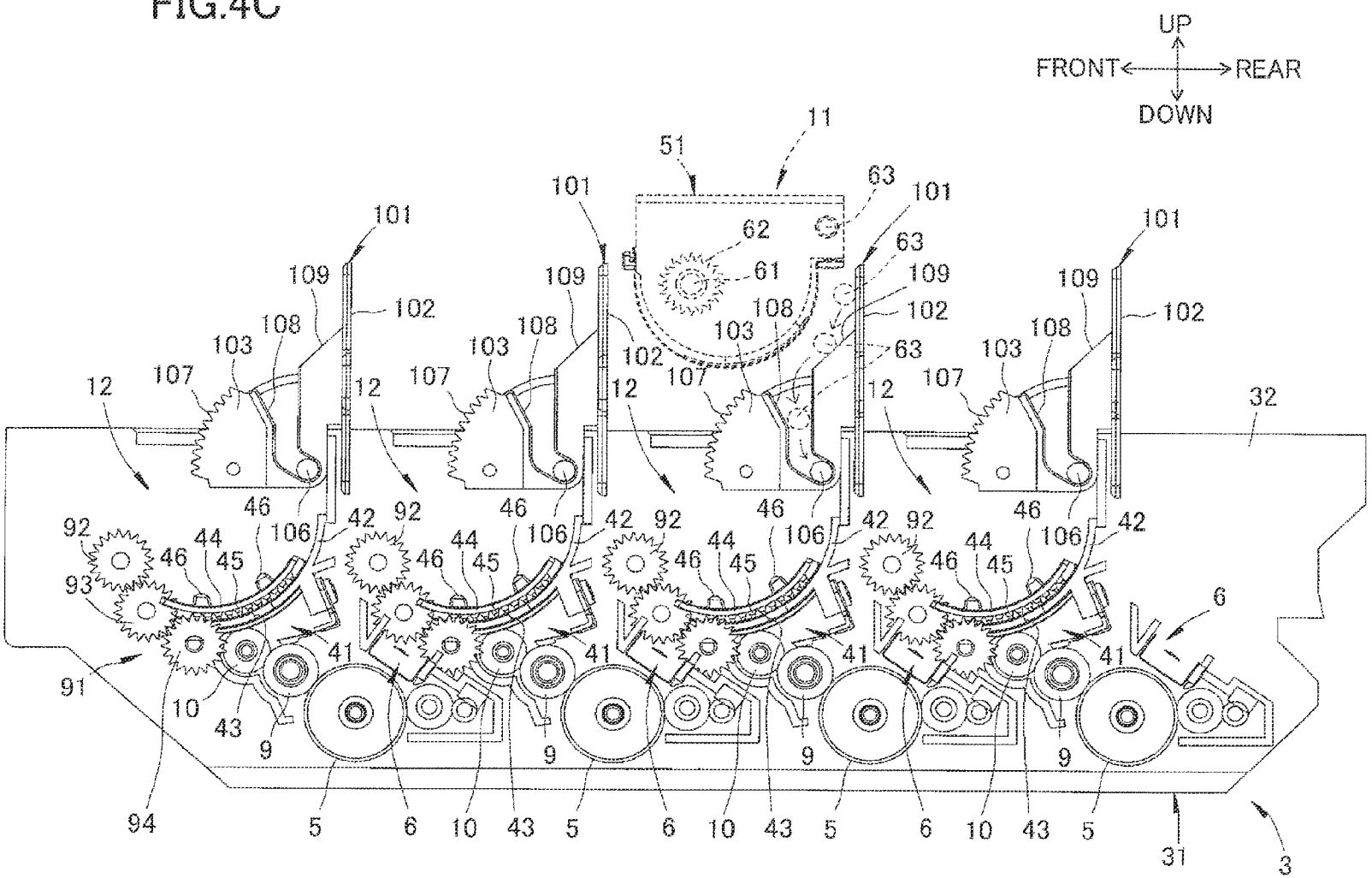
FIG. 4C is a cross-sectional right side view of the drawer unit and the toner cartridge detached from the drawer unit.

It is noted that only one toner cartridge 11 is shown in FIGS. 4A-4C, while the other three toner cartridges 11 have been omitted from the drawings.

Four shutter drive members 44 are movably disposed above the four partitioning walls 42, respectively.

Each shutter drive member 44 is for driving a shutter 73 to be described later, and is formed in a plate shape protruding toward the developing chamber 41 in an arc shape that substantially follows the partitioning wall 42. A rack gear 45 is formed at a left end section on a bottom surface of the shutter drive member 44. An upper surface of the shutter drive member 44 is formed with pairs of shutter drive protrusions 46 at positions opposite to pairs of shutter drive openings 88 (FIG. 5) to be described later.

The shutter drive member 44 will be described in greater detail with reference to FIGS. 4D and 4E.

Figure 4D:
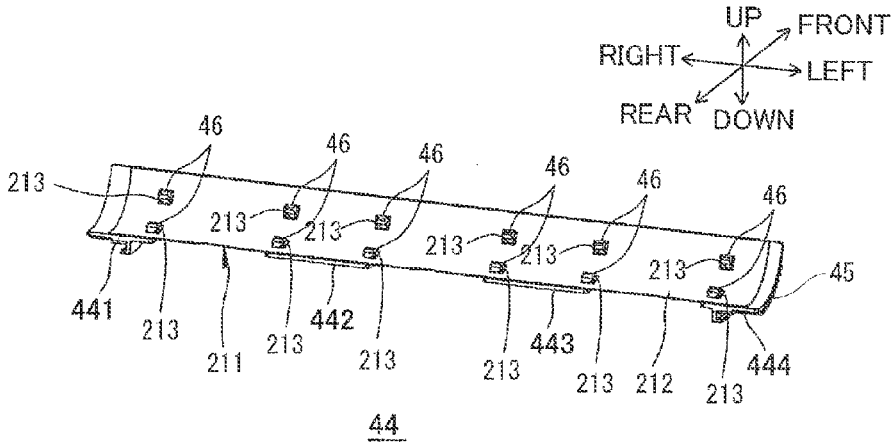
FIG. 4D is a perspective view of a shutter drive member shown in FIG. 4B.

As shown in FIG. 4D, each shutter drive member 44 includes a main body part 211 formed of a resin, and a reinforcing plate 212 formed of a thin metal plate that is affixed to the main body part 211.

Figure 4E:
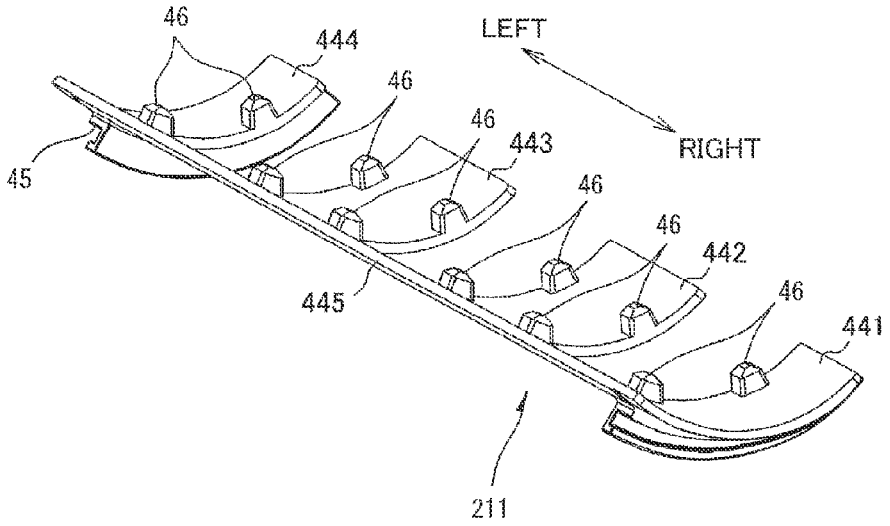
FIG. 4E is a perspective view of a main body part of the shutter drive member shown in FIG. 4D.

As shown in FIG. 4E, the main body part 211 is integrally configured of four plate-shaped parts 441, 442, 443, and 444 arranged at intervals in the left-to-right direction; and a coupling part 445 having a bar shape that extends in the left-to-right direction for coupling the front edges of the plate-shaped parts 441-444. Each of the plate-shaped parts 441-444 is formed of a plate curved in an arc, with the convex side facing the developing chamber 41. The curved arc of the plate-shaped part substantially conforms to the shape of the partitioning wall 42.

The shutter drive member 44 is provided above the partitioning wall 42 of each developing unit frame 8.

The rack gear 45 is formed on the bottom surface of the plate-shaped part 444 for engaging with a third transmission gear 94 to be described later.

As will be described later, the shutter drive member 44 can move between a position opposing the rectangular openings 43 (the position shown in FIGS. 4B and 7E) and a position forward of the rectangular openings 43 and not opposing the rectangular openings 43 (shown in FIGS. 7B and 7D).

The shutter drive protrusions 46 are formed on the top surfaces of the plate-shaped parts 441-444 at positions corresponding to the shutter drive openings 88 described later.

The reinforcing plate 212 covers the entire region of the main body part 211, excluding the right edge of the plate-shaped part 441 and the left edge of the plate-shaped part 444. Insertion through-holes 213 are formed in the reinforcing plate 212 at positions overlapping the shutter drive protrusions 46. Each of the shutter drive protrusions 46 is inserted through a corresponding insertion through-hole 213 and protrudes upward from the reinforcing plate 212.

By overlaying the reinforcing plate 212 on the main body part 211 in this way, it is possible to ensure sufficient rigidity of the shutter drive member 44 so that the shutter drive member 44 can move the shutter 73 with sufficient stability.

Further, by inserting the shutter drive protrusions 46 through the insertion through-holes 213 in the reinforcing plate 212, the position of the reinforcing plate 212 relative to the main body part 211 remains fixed with the shutter drive protrusions 46 protruding from the reinforcing plate 212.

Since the three rectangular openings 43 formed in the partitioning wall 42 are opened and closed by the reinforcing plate 212 moving in association with the shutter drive member 44, the reinforcing plate 212 functions as a developing-device-side shutter for opening and closing the rectangular openings 43.

As shown in FIGS. 4A-4C, a cover member 101 (operating member) is provided in the drawer frame 31 for each space 12. Each cover member 101 is integrally provided with a main cover part 102 (restricting part) formed in a flat plate shape and elongated in the left-to-right direction, and a fan-shaped drive gear part 103 shaped substantially like one quadrant of a circle in a side view. The drive gear part 103 is connected to the left edge of the main cover part 102. The cover member 101 can be displaced between a first position or first posture in which the main cover part 102 extends upward, protruding above the drawer frame 31, and a second position or second posture in which the main cover part 102 extends along the top edges of the drawer frame 31.

In the following description of the structure of the cover member 101, it is assumed that the cover member 101 is in the first position.

The cover member 101 is formed of a size capable of covering substantially the entire top region of the corresponding space 12. As shown in FIG. 4A, a rectangular left engaging part 104 is formed on the left edge of the main cover part 102. The left engaging part 104 protrudes farther leftward than the drive gear part 103. A rectangular right engaging part 105 protrudes from the right edge of the main cover part 102. The right engaging part 105 has a smaller length in the front-to-rear direction than the left engaging part 104 when the cover member 101 is in the second position.

A portion of the drive gear part 103 forming one radial edge of the fan shape is connected to the main cover part 102, while a portion of the drive gear part 103 forming the arc of the fan shape protrudes diagonally forward and upward. As shown in FIG. 4B, a pivoting shaft 106 is rotatably inserted into the drive gear part 103 near the radial center of the fan shape. The pivoting shaft 106 extends in the left-to-right direction. The left end of the pivoting shaft 106 is supported in the left side plate 32 so as to be incapable of rotating relative to the same. Through this structure, the cover member 101 is pivotably supported on the left side plate 32 through the pivoting shaft 106. By pivoting about the pivoting shaft 106, the cover member 101 can be displaced between the first position and second position.

Gear teeth 107 are formed along the lower half portion of the drive gear part 103 constituting the arc-shaped edge.

As shown in FIG. 4C, a guide groove 108 (guide portion) is formed in the right surface of the drive gear part 103. The guide groove 108 opens at the upper half portion of the drive gear part 103 forming the arc-shaped edge, and extends downward and then bends in a direction diagonally downward and rearward, leading to the region in which the pivoting shaft 106 is inserted. A sloped guide surface 109 is formed between the upper edge of the guide groove 108 and the inner surface of the main cover part 102, sloping upward to the rear.

As shown in FIG. 4A, recessed parts 110 and 111 are formed in the top surfaces of the side plates 32 and 33, respectively, for receiving the engaging parts 104 and 105. The recessed parts 110 and 111 are rectangular in a plan view. When the cover member 101 is in the second position, the corresponding engaging parts 104 and 105 are fitted into the tops of the recessed parts 110 and 111. Accordingly, the engaging parts 104 and 105 engage with the side plates 32 and 33 in the recessed parts 110 and 111, respectively, thereby maintaining the cover member 101 in the second position. The depth of the recessed parts 110 and 111 is substantially equivalent to the thickness of the main cover part 102. Hence, the top surface of the cover member 101 is substantially flush with the top edges of the side plates 32 and 33 when the cover member 101 is in the second position as shown in FIG. 3.

As shown in FIG. 4A, support grooves 112 and 113 are formed in the inner surface (left surface) of the right side plate 33 at positions to the front and to the rear of each recessed part 111, respectively. Specifically, one support groove 112 is formed on the front side of each recessed part 111, and one support groove 113 is formed on the rear side. The support grooves 112 and 113 are elongated vertically and open in the top edge of the right side plate 33. The top ends of the support grooves 112 and 113 widen toward the top, giving the support grooves 112 and 113 a general Y-shape in a side view.

Figure 5:
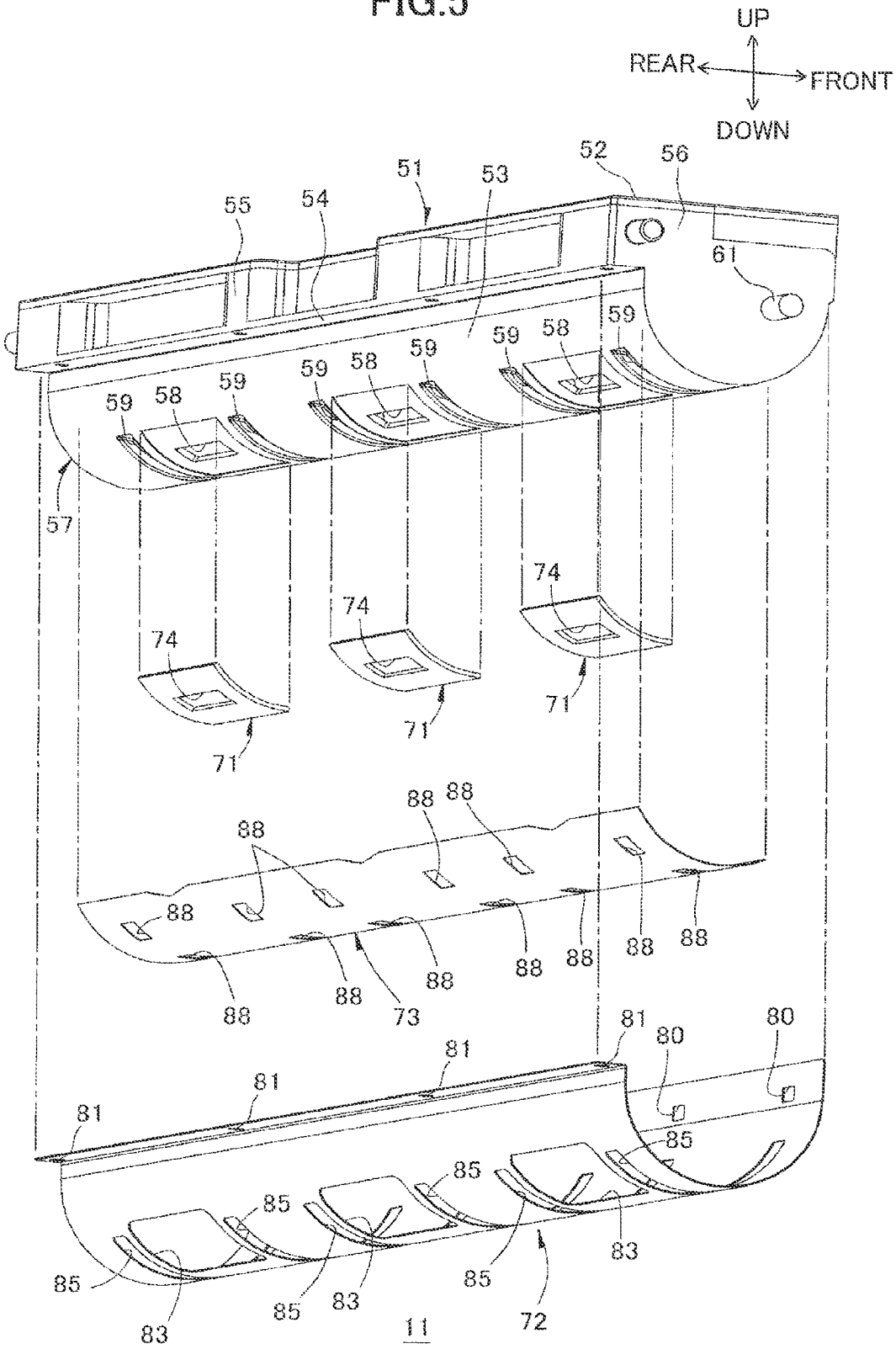
FIG. 5 is an exploded perspective view of the toner cartridge shown in FIG. 4A.

As shown in FIG. 5, the toner cartridge 11 includes a casing 51 formed of resin for accommodating toner therein. The casing 51 is formed substantially in a hollow semicircular column shape with a longer dimension in the right-left direction. More specifically, the casing 51 defines a space therein for accommodating toner, and has an upper surface 52 substantially in a rectangular shape elongated in the right-left direction, an arc surface (outer circumferential surface) 53 connected to a front edge of the upper surface 52 and protruding downward in an arc shape to form substantially a semicircular shape in cross-section, a fixing surface 54 extending rearward parallel to the upper surface 52 from a rear edge of the arc surface 53, a rear surface 55 spanning between a rear edge of the upper surface 52 and a rear edge of the fixing surface 54, a left surface 56 spanning between left edges of the surfaces 52, 53, 54, and 55, and a right surface 57 spanning between the right edges of the surfaces 52, 53, 54, and 55.

The arc surface 53 is formed with the three communication ports (through-holes) 58 mentioned above at positions slightly rearward of a lowest section of the arc surface 53 for fluidly connecting between inside and outside of the casing 51. The communication ports 58 are formed at fixed intervals in the right-left direction, and each is formed in a rectangular shape elongated in the right-left direction.

The arc surface 53 is also formed with an escape groove 59 on each of the right and left sides of each communication port 58. Each escape groove 59 is narrow in the right-left direction and extending along a circumferential direction of the arc surface 53.

As shown in FIG. 4A, a plurality of positioning protrusions 60 is formed at fixed intervals along the right-left direction at a front end section on the arc surface 53. Each of the positioning protrusions 60 extends frontward and bends upward into a hook (see FIG. 4B).

A circular column-shaped boss 61 protrudes from the left surface 56 at substantially a center position of a region surrounded by a circumferential edge of the arc surface 53. A driven gear 62 is rotatably held on the boss 61. A circular column-shaped support protrusion 63 is formed at an upper rear section on the left surface 56.

It is noted that in FIG. 5, the driven gear 62 has been omitted from the drawing.

A circular column-shaped support protrusion 64 (FIG. 4A) is formed on the right surface 57 at substantially a center position of a region surrounded by a circumferential edge of the arc surface 53. Although not shown, another circular column-shaped support protrusion is formed also at an upper rear section on the right surface 57.

As shown in FIG. 5, the toner cartridge 11 further includes toner seals 71 attached on the arc surface 53 of the casing 51, a shutter cover 72 for covering over the arc surface 53, and the shutter 73 disposed between the arc surface 53 and the shutter cover 72.

The toner seals 71 are provided in correspondence with the communication ports 58, and each is formed in a sheet shape with an opening 74 corresponding to the communication port 58 and attached on the arc surface 53 of the casing 51 such that the opening 74 confronts and fluidly communicates with the communication port 58 and that the toner seal 71 surrounds the communication port 58.

The shutter cover 72 is made of a resin film and curved to follow the arc surface 53 of the casing 51. The shutter cover 72 has substantially the same width in the right-left direction as the arc surface 53 and covers substantially the entire width of the arc surface 53 in the right-left direction.

The shutter cover 72 is formed at a front end section thereof with a plurality of positioning openings 80 at intervals in the right-left direction. As shown in FIG. 4A, the positioning protrusions 60 formed on the arc surface 53 of the casing 51 engage with the respective positioning openings 80. More specifically, the front end section of the shutter cover 72 is formed with the positioning openings 80 having the size capable of receiving the positioning protrusions 60 at the same positions as the positioning protrusions 60 in the right-left direction. The positioning protrusions 60 are inserted through the positioning openings 80, and upper edges of the positioning openings 80 are engaged with the positioning protrusions 60.

As shown in FIG. 5, a rear end section of the shutter cover 72 is bent to extend along the fixing surface 54 of the casing 51, and is formed with a plurality of screw insertion through-holes 81 at intervals in the right-left direction. The shutter cover 72 is attached to the casing 51 by engaging the positioning openings 80 with the positioning protrusions 60, inserting screws 82 (FIG. 4B) through the screw insertion through-holes 81, and screwing the screws 82 into the fixing surface 54 of the casing 51.

The shutter cover 72 is also formed with a plurality of toner openings 83 at positions opposing the toner seals 71. Each toner opening 83 is formed in a rectangular shape with a long dimension in the right-left direction. The toner opening 83 has a larger area than the communication port 58 so as to entirely expose the communication port 58.

The shutter cover 72 is further formed with a plurality of guide openings or guide slits 85 at positions opposing the escape grooves 59 formed in the casing 51. Each guide opening 85 extends in the front-rear direction (in the circumferential direction of the shutter cover 72) to a length equal to or greater than a length of the escape groove 59 in the front-rear direction, and each guide opening 85 has a greater width than the escape groove 59 in the right-left direction. The guide opening 85 opposes the entire region of the corresponding escape groove 59.

The shutter 73 is made of a resin film and curved along the arc surface 53 of the casing 51. The shutter 73 is interposed between the arc surface 53 of the casing 51 and the shutter cover 72 and is moved between an opening position and a closed position while supported by the arc surface 53 and the shutter cover 72.

The shutter 73 has a slightly smaller length than the shutter cover 72 with respect to the right-left direction, and a greater width than the toner seal 71 with respect to the circumferential direction of the arc surface 53, which width is set such that the shutter 73 does not contact the fixing surface 54 of the casing 51 nor the positioning protrusions 60 (FIG. 4A) when the shutter 73 is moved between the opening position and the closed position.

The shutter 73 is formed with pairs of shutter driving openings 88 at positions opposing the escape grooves 59. The two shutter driving openings 88 of each pair are spaced apart from each other in the circumferential direction of the shutter 73. The gap between the two shutter driving openings 88 of each pair is determined such that all of the shutter driving openings 88 oppose and fluidly communicate with both the escape grooves 59 and the guide openings 85 regardless of whether the shutter 73 is located at the opening position or the closed position.

Figure 7A:
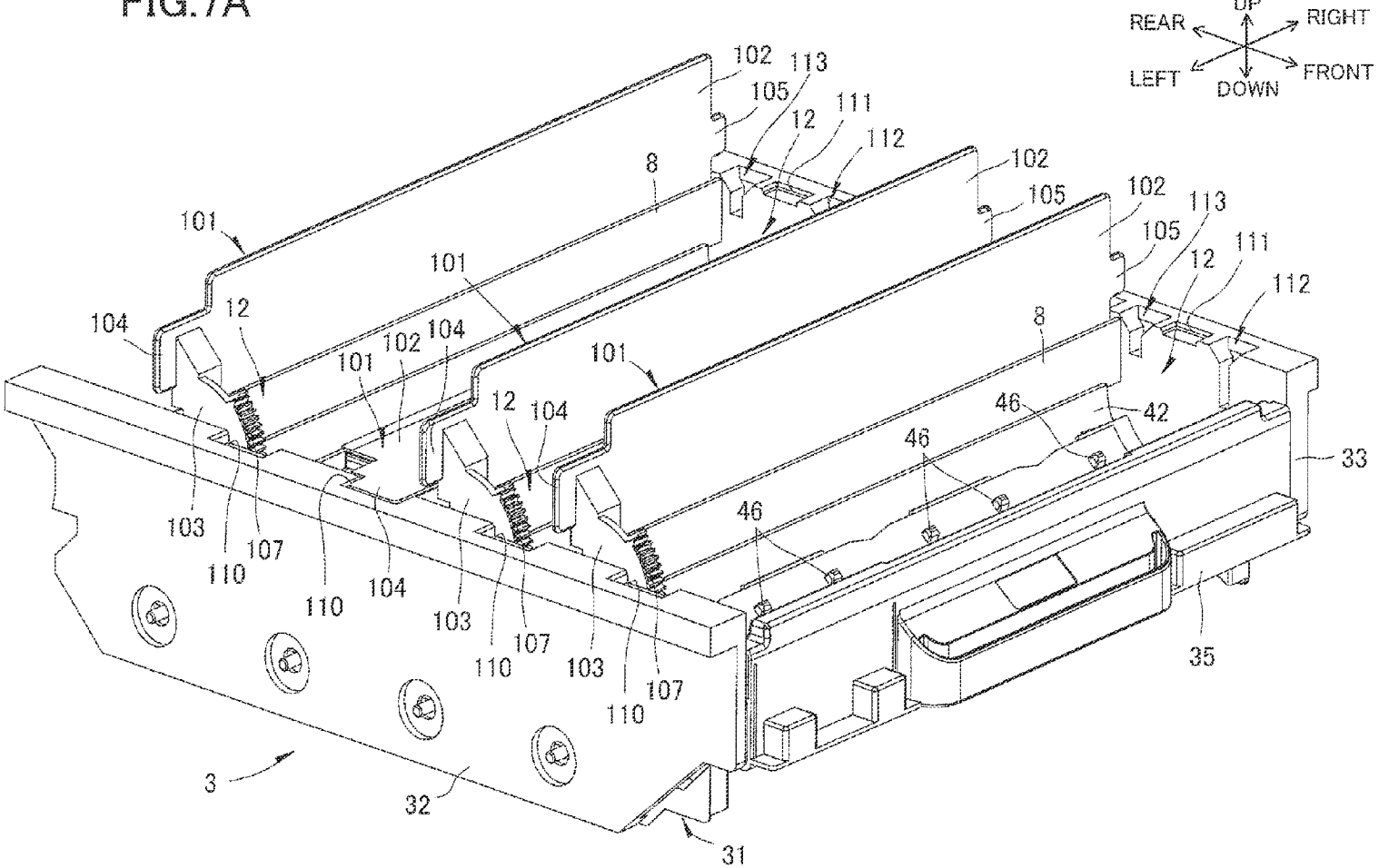
FIG. 7A is a perspective view of the drawer unit with one toner cartridge accommodated therein and one cover member in a second position and the other remaining three cover members in the first positions.
Figure 7B:
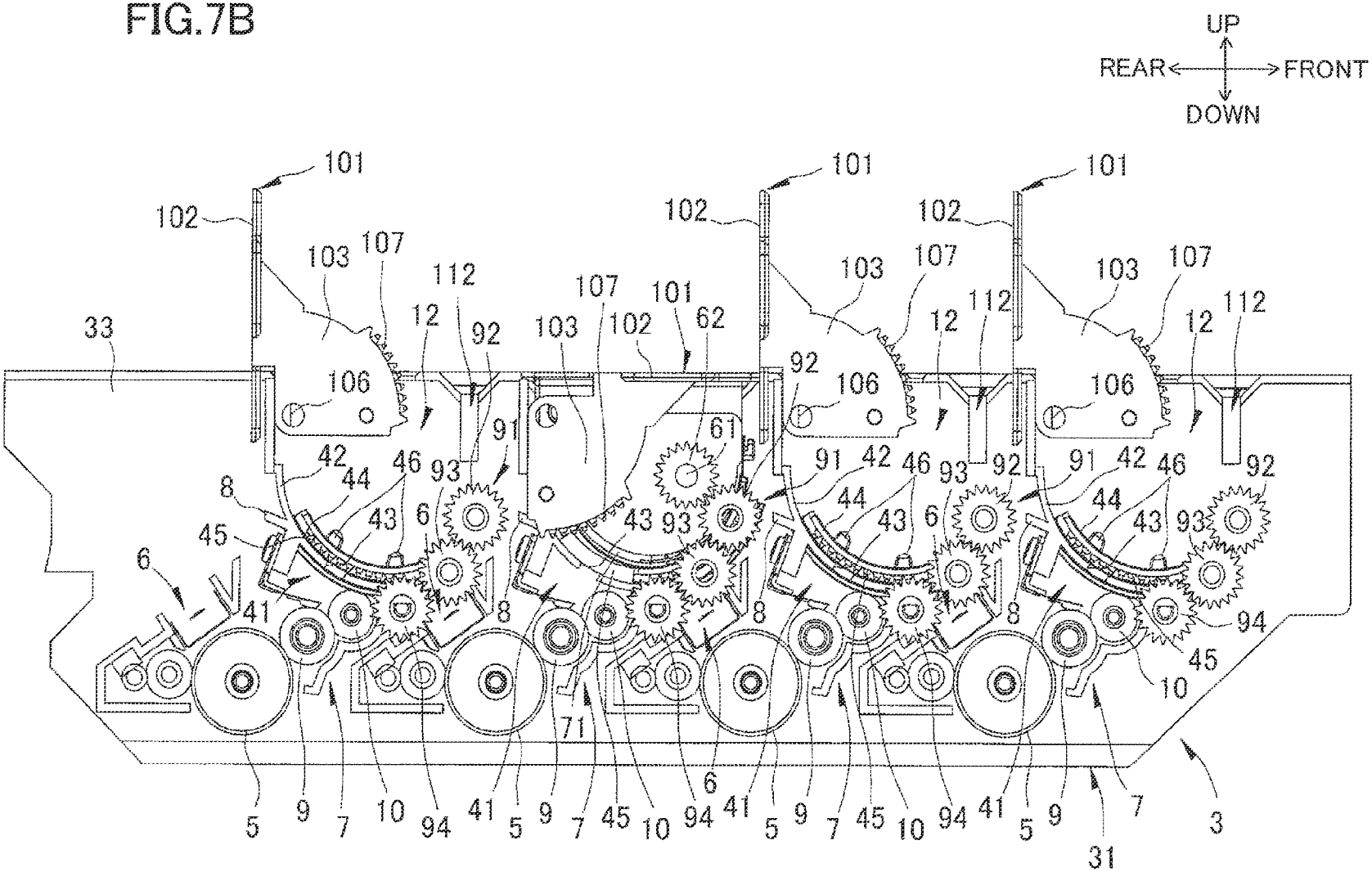
FIG. 7B is a cross-sectional left side view of the drawer unit with one toner cartridge accommodated therein and one cover member in the second position and the other remaining three cover members in the first positions.
Figure 7C:
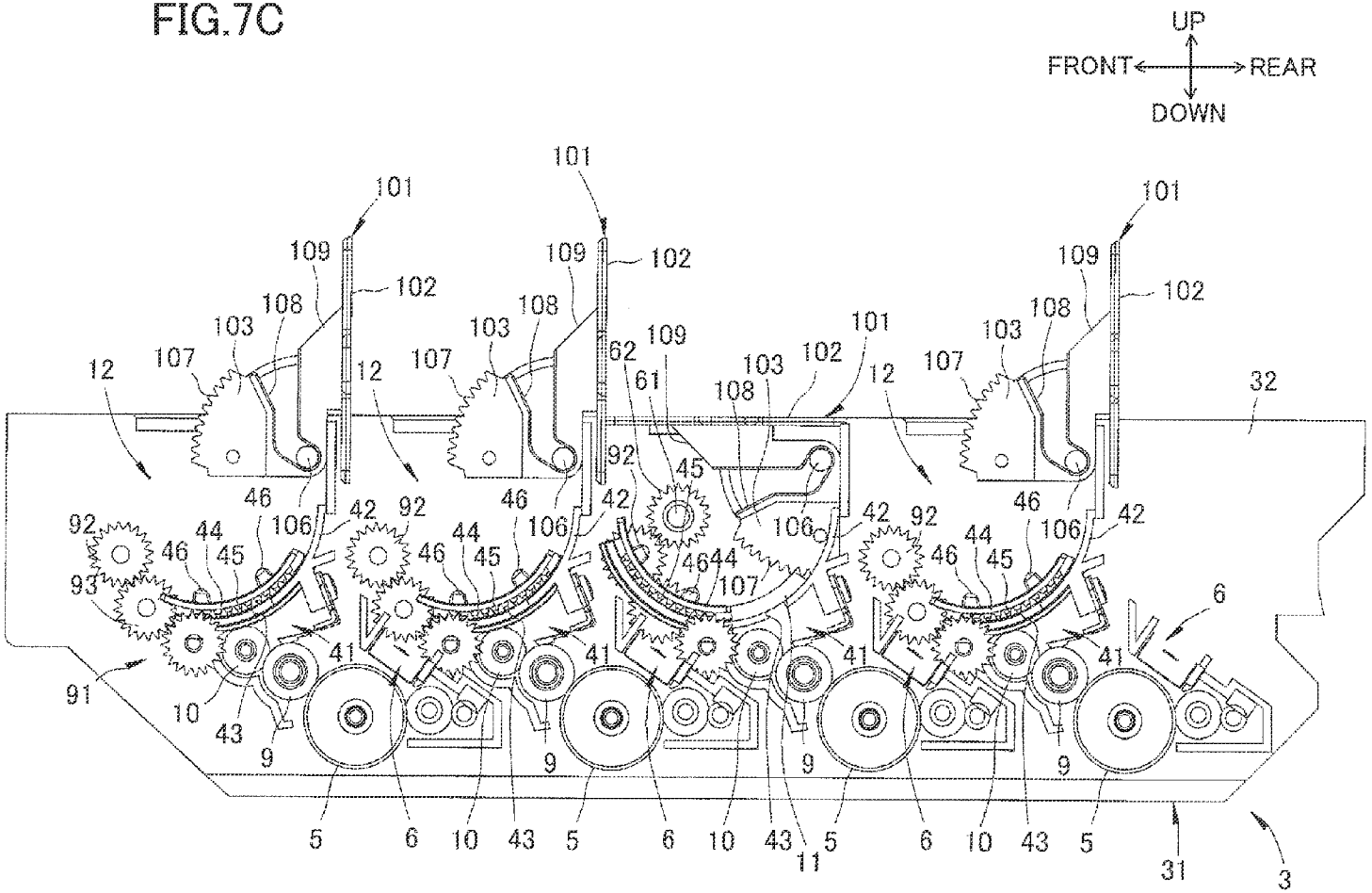
FIG. 7C is a cross-sectional right side view of the drawer unit with one toner cartridge accommodated therein and one cover member in the second position and the other remaining three cover members in the first positions.
Figure 7D:
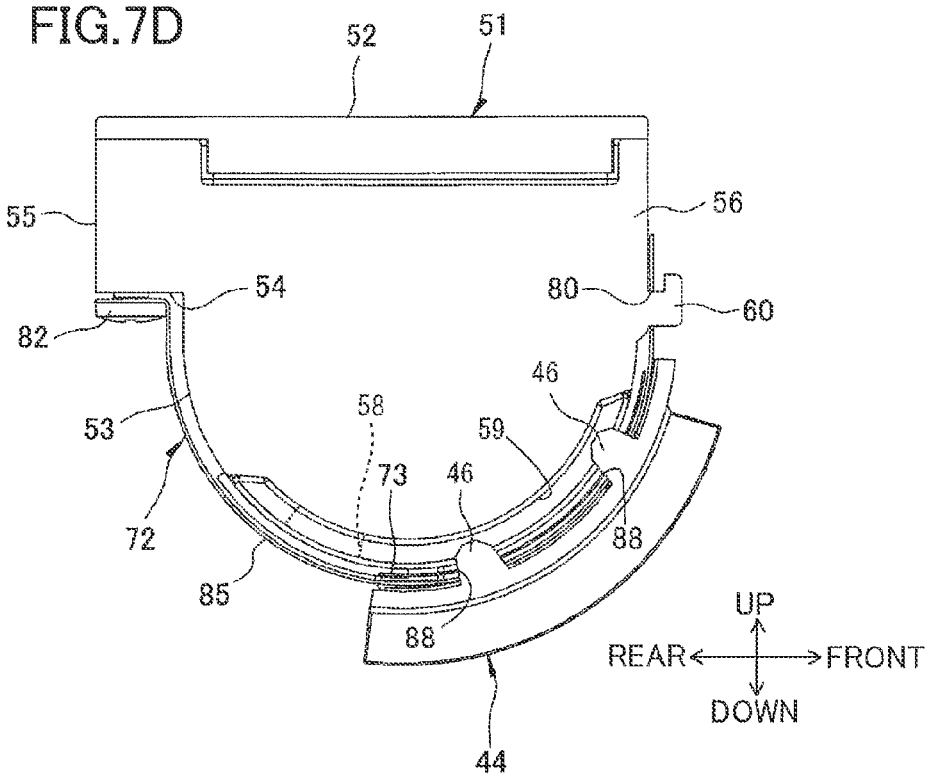
FIG. 7D is a cross-sectional view of the toner cartridge in FIG. 5 and the shutter drive member in FIG. 7B when the shutter is in the open position.
Figure 7E:
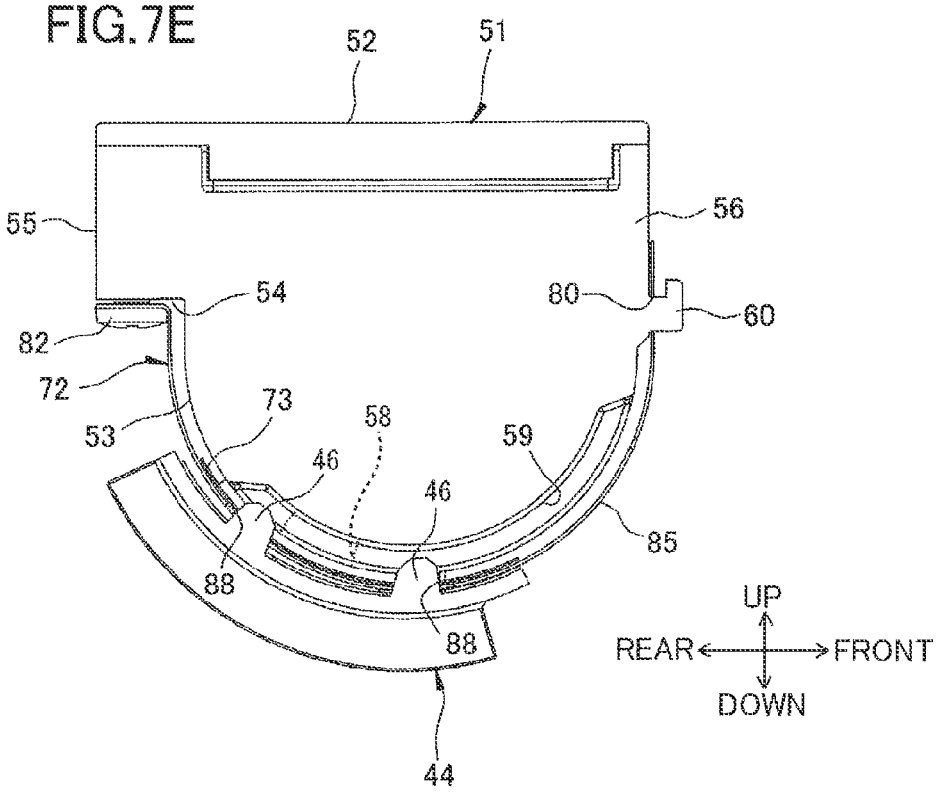
FIG. 7E is a cross-sectional view of the toner cartridge in FIG. 5 and the shutter drive member in FIG. 6B when the shutter is in the closed position.

When the toner cartridge 11 is accommodated into the space 12, the shutter drive protrusions 46 shown in FIGS. 4A-4B penetrate through the guide openings 85 and engage with the shutter driving openings 88 as shown in FIG. 7E, thereby linking the shutter drive member 44 to the shutter 73.

When the shutter 73 is located at the opening position, a rear end section of the shutter 73 is located between front sections of the toner seals 71 and the shutter cover 72, and the rear end section of the shutter 73 is located frontward of the openings 74 and the communication ports 58. Thus, the communication ports 58 in fluid communication with the openings 74 are exposed to fluidly communicate between inside and outside of the casing 51.

When the shutter 73 is located at the closed position rearward of the opening position, on the other hand, the rear end section of the shutter 73 is positioned slightly rearward of rear edges of the toner openings 83. The shutter 73 entirely covers over both the communication ports 58 of the casing 51 and the openings 74 of the toner seals 71 and blocks off the fluid communication between inside and outside of the casing 51. In this state, the toner seals 71 are interposed between the shutter 73 and the arc surface 53 of the casing 51.

A drive transmission mechanism 91 is provided in the drawer frame 31 for each of the shutter drive members 44. The drive transmission mechanism 91 functions to transmit the rotation of the driven gear 62 provided on the corresponding toner cartridge 11 to the rack gear 45 provided on the shutter drive member 44. As shown in FIG. 4B, each drive transmission mechanism 91 includes a first transmission gear 92 which is engaged with the driven gear 62 when the toner cartridge 11 is mounted in the space 12, a second transmission gear 93 engaged with the first transmission gear 92, and a third transmission gear 94 engaged with both of the second transmission gear 93 and the rack gear 45. The transmission gears 92, 93, and 94 are rotatably held on the left side plate 32 of the drawer frame 31.

When the driven gear 62 is rotated, the driven gear 62 applies a rotating force to the first transmission gear 92 for rotating the same. The first transmission gear 92 transfers this rotating force to the rack gear 45 via the transmission gears 93 and 94, moving the shutter drive member 44 along the partitioning wall 42 in a front or rear direction and shifting the shutter 73 coupled with the shutter drive member 44 between the open position and closed position described later. Hence, the driven gear 62, first transmission gear 92, second transmission gear 93, third transmission gear 94, and rack gear 45 constitute a drive mechanism (gear train) for moving the shutter 73 between the open position and closed position.

Attachment and detachment of the toner cartridge 11 will be described next. As shown in FIGS. 4A and 4B, the toner cartridge 11 is attached into and detached from the space 12 of the drawer frame 31 while the drawer unit 3 (the drawer frame 31) is located at the pull-out position (FIG. 3). When the drawer unit 3 is at the pull-out position, as shown in FIG. 3, the drawer unit 3 protrudes outwardly from the inside of the main casing 2 so that the cover members 101 for all the four spaces 12 can be accessed and operated by an operator and the toner cartridges 11 can be mounted to and detached from all the four spaces 12. Each toner cartridge 11 can be attached into the corresponding space 12 from above, and can be detached upwardly from the corresponding space 12. Note that attachment of the toner cartridge 11 into the space 12 also means attachment of the toner cartridge 11 onto the developing unit 7.

When the toner cartridge 11 is not attached in the drawer unit 3, the shutter 73 is located at the closed position.

When mounting a toner cartridge 11 in the corresponding space 12, the cover member 101 corresponding to this space 12 is in the first position, as shown in FIGS. 4A through 4C. At the beginning of the mounting operation, the support protrusion 63 protruding from the left side surface 56 of the case 51 is inserted into the top of the guide groove 108 formed in the cover member 101. Similarly, the support protrusion 64 and the other support protrusion (not shown) protruding from the right side surface 57 of the case 51 are respectively inserted into the tops of the support grooves 112 and 113 formed in the right side plate 33.

Figure 6A:
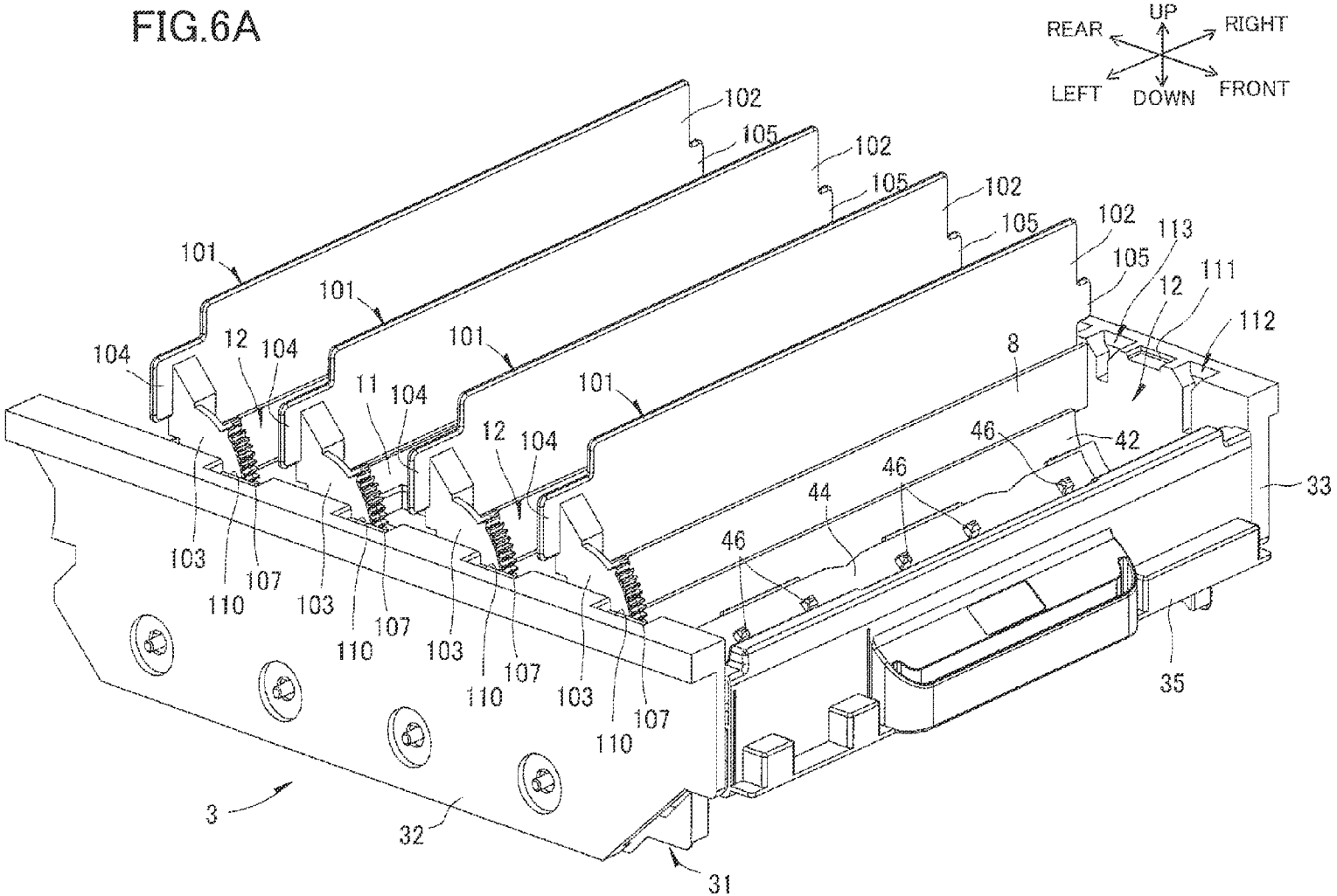
FIG. 6A is a perspective view of the drawer unit with one toner cartridge accommodated therein and cover members in first positions.

As indicated by dashed lines in FIG. 4C, the support protrusion 63 is guided toward the guide groove 108 along the inner surface of the main cover part 102 and the sloped guide surface 109. Through this guidance, the support protrusion 64 and the other support protrusion (not shown) on the right side surface 57 are guided to the support grooves 112 and 113. The support protrusion 63 is guided downward in the guide groove 108, and the support protrusion 64 and other support protrusion on the right side are guided downward in the support grooves 112 and 113. When the support protrusion 63 reaches the deepest part of the guide groove 108 and the support protrusion 64 and other support protrusion reach the deepest parts of the support grooves 112 and 113, the toner cartridge 11 is supported in the drawer frame 31, as illustrated in FIGS. 6A and 6B, and is completely mounted in the space 12.

Figure 6B:
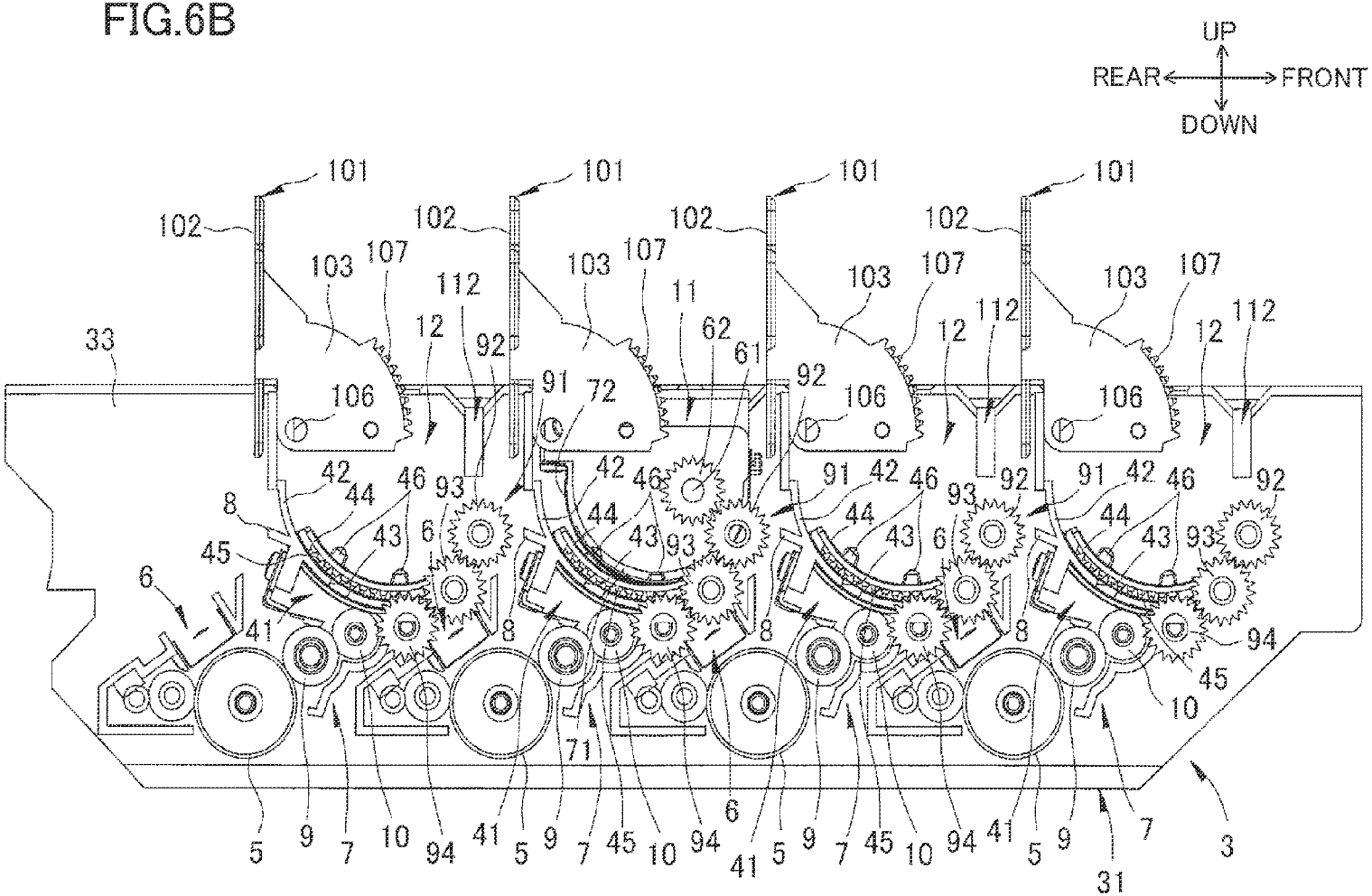
FIG. 6B is a cross-sectional left side view of the drawer unit with one toner cartridge accommodated therein and the cover members in the first positions.

In this state, the shutter drive protrusions 46 formed on the shutter drive member 44 are engaged in respective shutter drive openings 88 formed in the shutter 73 via the guide openings 85, thereby coupling the shutter 73 with the shutter drive member 44, as shown in FIG. 6B. Further, the driven gear 62 of the toner cartridge 11 is engaged with the first transmission gear 92, and the gear teeth 107 of the cover member 101 are disposed above the driven gear 62 and are not engaged with the same.

Next, the cover member 101 is displaced from the first position to the second position, as shown in FIGS. 7A, 7B, and 7C. As the cover member 101 is displaced to the second position, the gear teeth 107 rotate clockwise in a left side view. While rotating, the gear teeth 107 engages with the driven gear 62, after which the rotation of the gear teeth 107 rotate the driven gear 62 counterclockwise in a left side view. The rotation of the driven gear 62 produces a rotating force that is transmitted to the third transmission gear 94 via the transmission gears 92 and 93, rotating the third transmission gear 94 clockwise in a left side view. As the third transmission gear 94 rotates, the shutter drive member 44 moves forward from a position opposing the through-holes 43 to a position not opposing the through-holes 43. As the shutter drive member 44 moves in this way, the shutter 73 moves forward together with the shutter drive member 44 from the closed position to the open position shown in FIGS. 7B and 7C.

Next will be described in greater detail, with reference to FIGS. 7D and 7E, how the shutter 73 moves forward together with the shutter drive member 44 from the closed position to the open position.

When a toner cartridge 11 is not mounted in the corresponding space 12, the corresponding shutter drive member 44 above the partitioning wall 42 is positioned opposite the rectangular openings 43 formed in the partitioning wall 42, as shown in FIG. 4B.

At this time, the shutter drive protrusions 46 positioned closer to the front side among the pairs of shutter drive protrusions 46 formed in the shutter drive member 44 protrude upward along a substantially vertical direction, while the shutter drive protrusions 46 positioned closer to the rear protrude in a direction angled upward and forward, as shown in FIG. 7E. When the toner cartridge 11 is mounted in the space 12, each of the shutter drive protrusions 46 engages in a corresponding shutter drive opening 88 through the corresponding guide opening 85 (see FIG. 6B). At this stage, the shutter 73 in the toner cartridge 11 is at the closed position, and therefore the communication ports 58 indicated by broken lines in FIG. 7E are closed by the shutter 73.

When the cover member 101 is displaced from the first position to the second position, the shutter drive member 44 is driven by the third transmission gear 94 to move forward from the position confronting the rectangular openings 43 (shown in FIG. 7E) to a position not confronting the rectangular openings 43 (shown in FIG. 7D). In association with the movement of the shutter drive member 44, the shutter 73 moves forward from the closed position to the open position. When the shutter 73 is at the open position, the rear end of the shutter 73 is located forward of the communication ports 58 to thereby expose the communication ports 58, which are indicated by broken lines in FIG. 7D.

As shown in FIGS. 7A-7C, when the cover member 101 is in the second position, the main cover part 102 confronts the top of the toner cartridge 11 and covers the same. Consequently, the toner cartridge 11 cannot be removed from the drawer frame 31 in this state. Hence, the main cover part 102 of the cover member 101 functions to restrict detachment of the toner cartridge 11 from the drawer frame 31.

When the front cover 4 (FIG. 1) is closed thereafter, then the color printer 1 is ready to start image forming operation.

It is noted that only one toner cartridge 11 is shown in FIGS. 6A, 6B, 7A-7C, while the other three toner cartridges 11 have been omitted from the drawings.

When detaching a toner cartridge 11 from the drawer unit 3, first the front cover 4 is opened, and then the drawer unit 3 is pulled from the accommodated position to the pull-out position.

Next, the cover member 101 is moved from the second position shown in FIGS. 7A and 7B to the first position shown in FIGS. 6A and 6B. In accordance with this movement of the cover member 101, the shutter 73 moves from the opening position to the closed position in an operation reverse to the operation executed when the toner cartridge 11 is attached to the drawer unit 3.

Next, as shown in FIGS. 4A-4C, the desired toner cartridge 11 is detached upwardly from the corresponding space 12. When the toner cartridge 11 is removed from the drawer unit 3, the shutter 73 is in the closed position. So, toner does not leak from the casing 51 of the detached toner cartridge 11.

As described above, the drawer frame 31 can be moved between the accommodated position inside the main casing 2, and the pull-out position outside of the main casing 2. The drawer frame 31 retains four developing units 7, as well as four toner cartridges 11. The toner cartridges 11 are provided one for each of the developing units 7 and can be mounted in the drawer frame 31 when the drawer frame 31 has been pulled out to the pull-out position.

Each of the toner cartridges 11 includes a casing 51 for accommodating toner. The through-holes 58 are formed in the casing 51 for supplying toner to the corresponding developing unit 7. The toner cartridge 11 is also provided with the shutter 73, which is capable of moving between an open position for opening the through-holes 58 and a closed position for closing the through-holes 58.

The drawer frame 31 is provided with cover members 101. Each cover member 101 effects movement of the shutter 73 when shifted between a first position and second position. That is, when the cover member 101 is shifted from the first position to the second position, the shutter 73 moves from the closed position to the open position. Conversely, when the cover member 101 is shifted from the second position to the first position, the shutter 73 moves from the open position to the closed position.

Each cover member 101 extends above the drawer frame 31 in the first position, but has a lower posture in the second position. Accordingly, the cover members 101 are noticeable when the corresponding shutters 73 are in the closed position, and the user or operator of the color printer 1 can easily discern that a shutter 73 is still in the closed position when noticing the corresponding cover member 101. Therefore, the user or operator can recognize that the cover member 101 must be shifted from the first position to the second position in order to move the shutter 73 into the open position, prior to inserting the drawer frame 31 into the accommodated position inside the main casing 2.

Therefore, this construction prevents an operator from inserting the drawer frame 31 into the main casing 2 with toner cartridges 11 mounted in the drawer frame 31 when the shutter 73 of some toner cartridge 11 remains in the closed position, that is, when the through-holes 58 are closed by the shutter 73.

As described above, the toner cartridge 11 includes the driven gear 62, and the cover member 101 has the drive gear part 103. Hence, when the cover member 101 is shifted between the first position and second position, the drive gear part 103 of the cover member 101 applies a drive force to the driven gear 62 for moving the shutter 73 between the open position and closed position. Accordingly, movement of the shutter 73 between the open position and closed position can be achieved through a simple construction.

When the cover member 101 is in the second position, the main cover part 102 of the cover member 101 restricts the toner cartridge 11 from becoming detached from the drawer frame 31. Accordingly, when the operator moves the drawer frame 31 from the pull-out position to the accommodated position after mounting toner cartridges 11 in the drawer frame 31 and shifting their respective cover members 101 from the first position to the second position, the toner cartridges 11 are restricted by the cover members 101 to prevent their detachment from the drawer frame 31. Further, detachment of the toner cartridges 11 from the drawer frame 31 is restricted when the cover members 101 are in the second position so that the respective shutters 73 are in the open position.

The main cover part 102 has a flat plate shape and covers the top of the corresponding toner cartridge 11 when the cover member 101 is in the second position. Hence, the user or operator is prevented from touching the toner cartridge 11 when the corresponding cover member 101 is in the second position, thereby more reliably preventing the toner cartridge 11 from being detached from the drawer frame 31.

When the cover member 101 is in the second position, the top surface of the cover member 101 is positioned flush with the top surface of the drawer frame 31 (the top edges of the side plates 32 and 33). Therefore, there is no need to allocate space in the main casing 2 for disposing the cover members 101, thereby reducing the required size of the main casing 2.

Guide parts are formed in the cover members 101 for guiding the respective toner cartridges 11 when the toner cartridges 11 are mounted in the drawer frame 31. This guiding configuration ensures that the toner cartridges 11 can be mounted in the drawer frame 31 simply and reliably.

The cover member 101 is configured so that the front edge of the cover member 101 that is defined for when the cover member 101 is in the second position moves when the cover member 101 moves between the first and second positions. Since the front edge of the cover member 101 in the second position is the edge on the upstream side relative to the direction in which the drawer frame 31 moves from the pull-out position to the accommodated position, even when the cover member 101 is left in the first position while the drawer frame 31 is being moved from the pull-out position to the accommodated position, the cover member 101 will contact the main casing 2 as the drawer frame 31 is being inserted therein and will be displaced from the first position to the second position. Consequently, this construction reliably prevents the drawer frame 31 from being mounted in the main casing 2 while the shutters 73 of the toner cartridges 11 remain in their closed positions.

The above construction also prevents the cover members 101 from being damaged simply by displacing the cover members 101 from the first position to the second position when the cover members 101 contact the main casing 2.

While the invention has been described in detail with reference to the specific embodiment thereof, it would be apparent to those skilled in the art that many modifications and variations may be made therein without departing from the spirit of the invention, the scope of which is defined by the attached claims.

Figure 8:
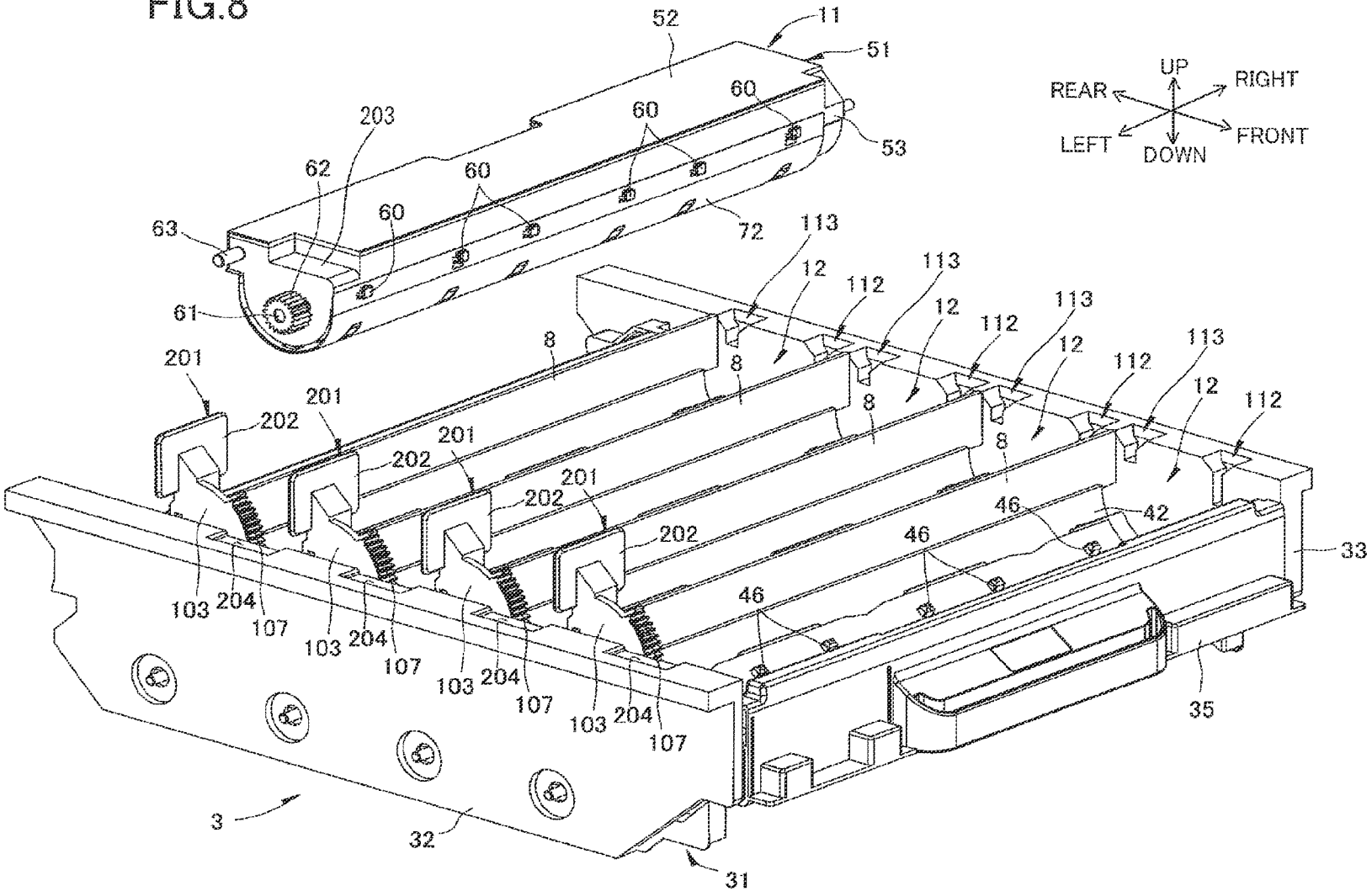
FIG. 8 is a perspective view of a drawer unit of a color printer according to a modification of the invention, with a toner cartridge detached from the drawer unit.
Figure 9:
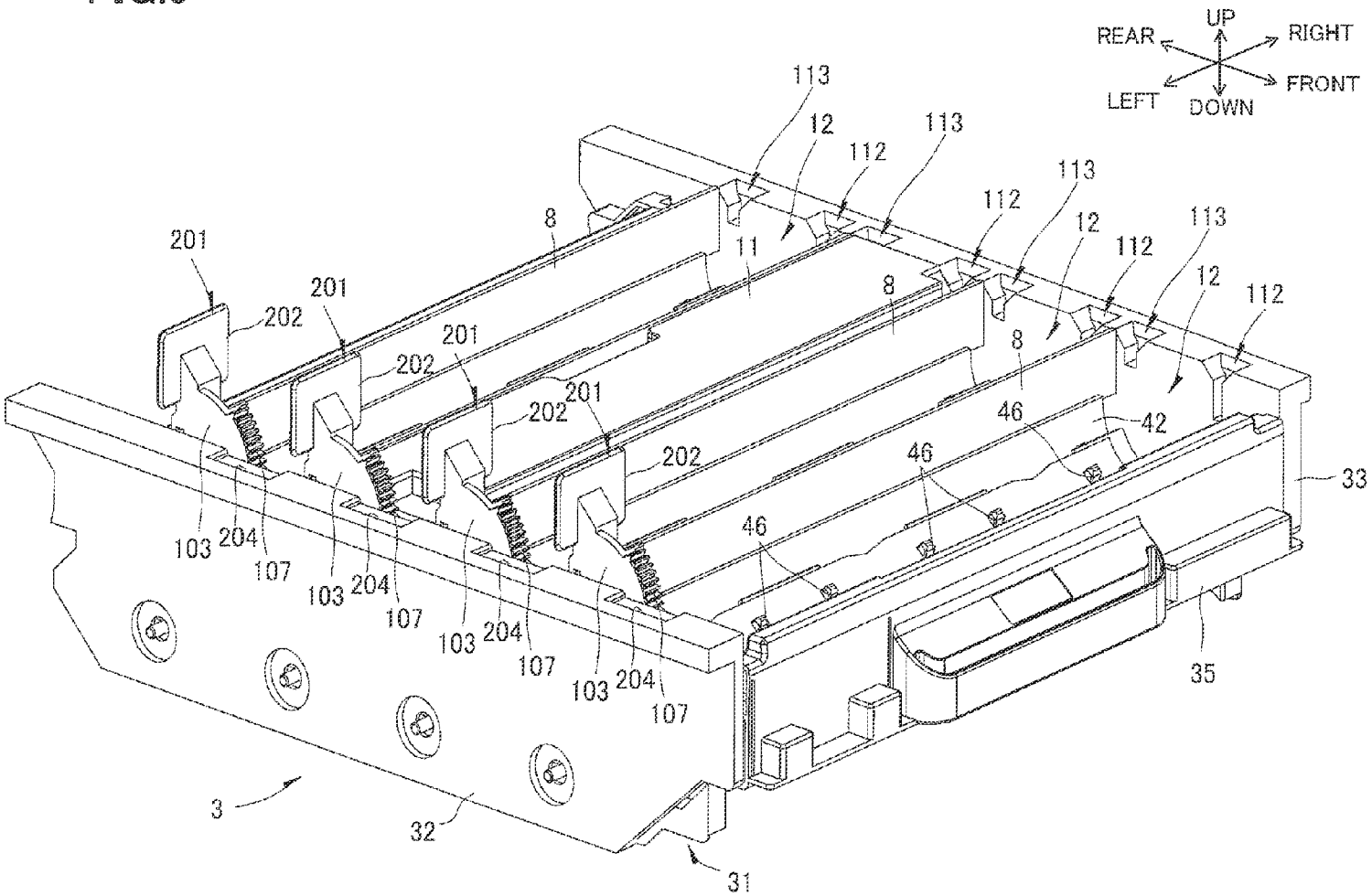
FIG. 9 is a perspective view of the drawer unit of FIG. 8 with one toner cartridge accommodated therein and operation members in first positions.
Figure 10:
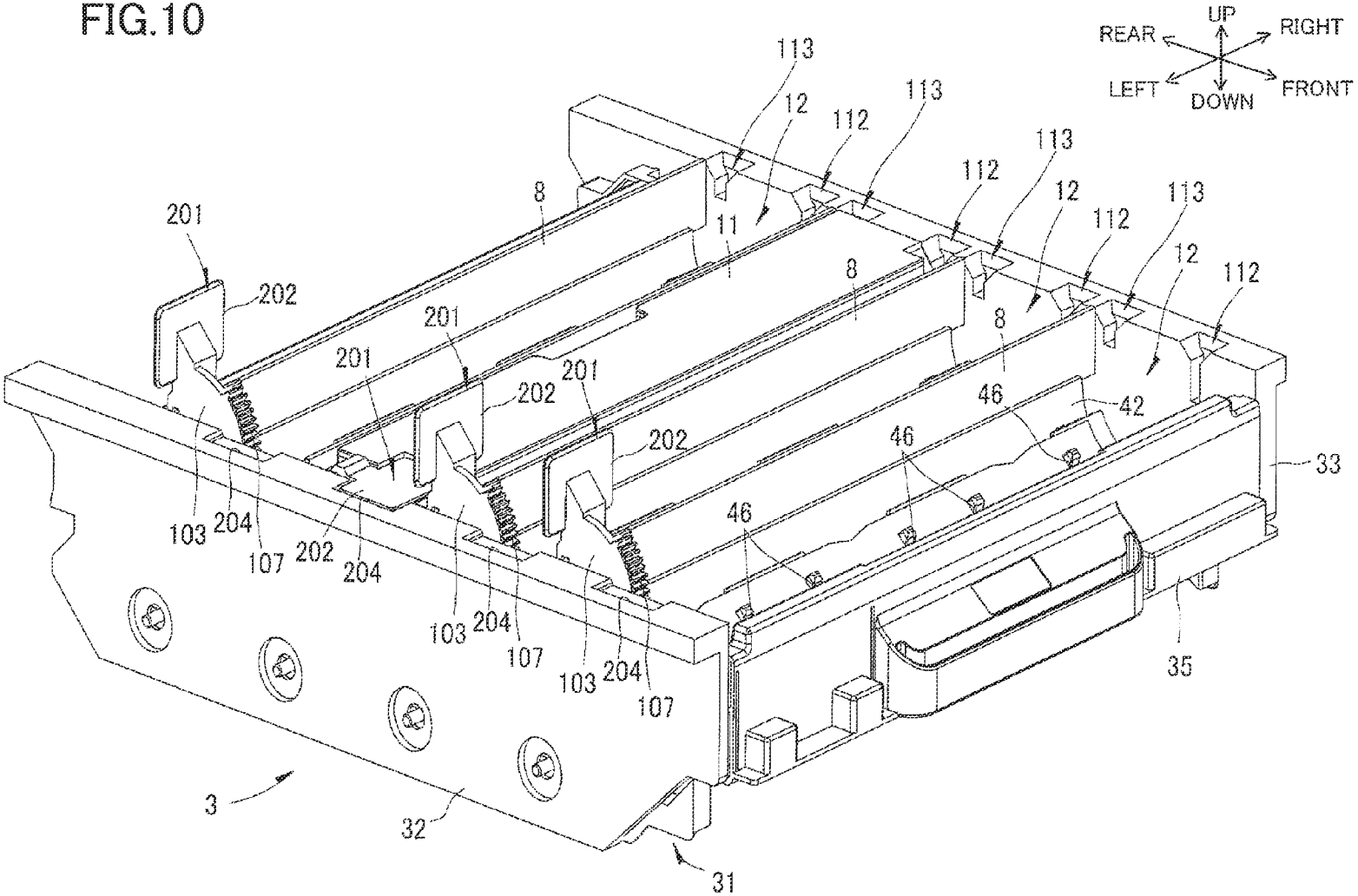
FIG. 10 is a perspective view of the drawer unit with one toner cartridge accommodated therein and one cover member in the second position and the other remaining three cover members in the first positions.

For example, in the structure of the embodiment described above, the main cover parts 102 cover the tops of the corresponding toner cartridges 11 (casings 51) when the cover members 101 are in the second position. However, the cover members 101 (see FIG. 4A) may be replaced with operating members 201, as shown in FIGS. 8, 9, and 10. Each operating member 201 is configured of a restricting part 202. When the operating member 201 is in the second position, the restricting part 202 confronts the top surface 52 on the left end of the casing 51 from above. The only difference between the cover member 101 and the operating member 201 is that the cover member 101 is provided with the main cover part 102 for covering the entire top surface 52 of the casing 51, while the operating member 201 has the rectangular plate-shaped restricting part 202 formed smaller than the main cover part 102.

In the construction of the drawer unit 3, as shown in FIG. 8, a recessed part 203 is formed in the top surface 52 of the casing 51 on the left front end thereof The recessed part 203 is rectangular in a plan view and is open on the left and front of the casing 51 for receiving the corresponding restricting part 202. A recessed part 204 is formed in the top surface of the left side plate 32 for receiving each restricting part 202. The recessed part 204 is rectangular in a plan view and has a depth substantially equivalent to the thickness of the restricting part 202. When the cover member 101 is in the second position, the restricting part 202 is fitted into the corresponding recessed parts 203 and 204. Hence, the bottom surface of the restricting part 202 contacts the top surface of the left side plate 32 inside the respective recessed part 204, while the top surface of the restricting part 202 is substantially flush with the top surface 52 of the casing 51 and the top edges of the side plates 32 and 33.

The drawer unit 3 having this construction can obtain the same operations and effects described in the embodiment.

Note that only one toner cartridge 11 is shown in FIGS. 8 through 10, while the other three toner cartridges 11 have been omitted from the drawings.

What is claimed is:

1. An image-forming device comprising:

a main casing defining an accommodation space;

a retaining member movably disposed between an accommodated position, in which the retaining member is accommodated inside the accommodation space, and a pull-out position;

a plurality of developing units that are retained by the retaining member;

a plurality of toner cartridges that are detachably attachable to the retaining member, one for each of the developing units, when the retaining member is at the pull-out position, each of the toner cartridges comprising:

a casing in which a through-hole is formed for supplying toner accommodated inside the casing to the corresponding developing unit; and a shutter that is configured to move between an open position exposing the through-hole and a closed position closing the through-hole; and an operating member provided at the retaining member, the operating member being configured to be operated to move the shutter of a toner cartridge between the open position and the closed position by shifting between a first position corresponding to the closed position of the shutter in which the operating member extends above the retaining member, and a second position corresponding to the open position of the shutter in which the operating member has a lower profile than in the first position.

2. The image-forming device according to claim 1, wherein each of the toner cartridges has a driven gear that receives a drive force for moving the corresponding shutter between the open position and the closed position; and the operating member has a drive gear unit that applies a drive force to the driven gear when the operating member is displaced between the first position and the second position.

3. The image-forming device according to claim 1, wherein the operating member has a restricting part that restricts detachment of the toner cartridge from the retaining member when the operating member is in the second position.

4. The image-forming device according to claim 3, wherein the restricting part is formed in a flat plate shape and covers a top of the toner cartridge when the operating member is in the second position.

5. The image-forming device according to claim 1, wherein the operating member is formed such that a top surface of the operating member occupies the same plane as a top surface of the retaining member when the operating member is in the second position.

6. The image-forming device according to claim 1, wherein the operating member has a guide portion that is configured to guide the toner cartridge when the toner cartridge is mounted in the retaining member.

7. The image-forming device according to claim 1, wherein the operating member is disposed such that an edge of the operating member on an upstream side, with respect to a direction that the retaining member moves from the pull-out position to the accommodated position, moves when the operating member is displaced between the first position and the second position.

8. A tandem-type process unit comprising:

a retaining member;

a plurality of image bearing members retained by the retaining member so as to be juxtaposedly arrayed with intervals between neighboring image bearing members;

a plurality of developing units that are retained by the retaining member, one for each of the image-bearing members;

a plurality of toner cartridges that are detachably attachable to the retaining member, one for each of the developing units, each of the toner cartridges comprising:

a casing in which a through-hole is formed for supplying toner accommodated inside the casing to the corresponding developing unit; and a shutter that is configured to move between an open position exposing the through-hole and a closed position closing the through-hole; and an operating member provided at the retaining member, the operating member being configured to be operated to move the shutter of a toner cartridge between the open position and the closed position by shifting between a first position corresponding to the closed position of the shutter in which the operating member extends above the retaining member, and a second position corresponding to the open position of the shutter in which the operating member has a lower profile than in the first position.

9. The tandem-type process unit according to claim 8, wherein each of the toner cartridges has a driven gear that receives a drive force for moving the corresponding shutter between the open position and the closed position; and the operating member has a drive gear unit that applies a drive force to the driven gear when the operating member is displaced between the first position and the second position.

10. The tandem-type process unit according to claim 8, wherein the operating member has a restricting part that restricts detachment of the toner cartridge from the retaining member when the operating member is in the second position.

11. The tandem-type process unit according to claim 10, wherein the restricting part is formed in a flat plate shape and covers a top of the toner cartridge when the operating member is in the second position.

12. The tandem-type process unit according to claim 8, wherein the operating member is formed such that a top surface of the operating member occupies the same plane as a top surface of the retaining member when the operating member is in the second position.

13. The tandem-type process unit according to claim 8, wherein the operating member has a guide portion that is configured to guide the toner cartridge when the toner cartridge is mounted in the retaining member.

14. The tandem-type process unit according to claim 8, wherein the operating member is further configured to restrict attachment and detachment of the toner cartridge to and from the retaining member when the operating member is in the second position and to enable the attachment and detachment of the toner cartridge to and from the retaining member when the operating member is in the first position.

15. The tandem-type process unit according to claim 8, further comprising a toner cartridge accommodating section defined in the retaining member for each toner cartridge such that the toner cartridge is detachably mountable in the corresponding toner cartridge accommodating section, and the operating member is configured to cover from above at least part of the toner cartridge accommodating section when the operating member is in the second position and to expose at least part of the toner cartridge accommodating section when the operating member is in the first position.

16. The image-forming device according to claim 1, wherein the operating member is further configured to restrict attachment and detachment of the toner cartridge to and from the retaining member when the operating member is in the second position and to enable the attachment and detachment of the toner cartridge to and from the retaining member when the operating member is in the first position.

17. The image-forming device according to claim 1, further comprising a toner cartridge accommodating section defined in the retaining member for each toner cartridge such that the toner cartridge is detachably mountable in the corresponding toner cartridge accommodating section, and the operating member is configured to cover from above at least part of the toner cartridge accommodating section when the operating member is in the second position and to expose at least part of the toner cartridge accommodating section when the operating member is in the first position.

18. The image-forming device according to claim 1, wherein the operating member is one of a plurality of operating members provided for each of the toner cartridges.

19. The tandem-type process unit according to claim 8, wherein the operating member is one of a plurality of operating members provided for each of the toner cartridges.

* * * * *